US009637300B2

(12) United States Patent
Dubois et al.

(10) Patent No.: US 9,637,300 B2
(45) Date of Patent: May 2, 2017

(54) LINER-BASED DISPENSER

(75) Inventors: Lawrence H. Dubois, Danbury, CT (US); Donald Ware, Woodbury, MN (US)

(73) Assignee: Entegris, Inc., Billerica, MA (US)

( * ) Notice: Subject to any disclaimer, the term of this patent is extended or adjusted under 35 U.S.C. 154(b) by 181 days.

(21) Appl. No.: 13/988,785

(22) PCT Filed: Nov. 22, 2011

(86) PCT No.: PCT/US2011/061764

§ 371 (c)(1),
(2), (4) Date: Jul. 22, 2013

(87) PCT Pub. No.: WO2012/071370

PCT Pub. Date: May 31, 2012

(65) Prior Publication Data

US 2013/0284766 A1 Oct. 31, 2013

Related U.S. Application Data

(60) Provisional application No. 61/416,444, filed on Nov. 23, 2010, provisional application No. 61/468,832, filed on Mar. 29, 2011.

(51) Int. Cl.

| | |
|---|---|
| ***B65D 83/00*** | (2006.01) |
| ***B05B 9/04*** | (2006.01) |
| ***B05B 9/08*** | (2006.01) |
| *B05B 7/24* | (2006.01) |

(52) U.S. Cl.

CPC ..... *B65D 83/0055* (2013.01); *B05B 9/0426* (2013.01); *B05B 9/0838* (2013.01); *B05B 9/0861* (2013.01); *B05B 7/2408* (2013.01)

(58) Field of Classification Search

CPC ..... B05B 7/241; B05B 7/2481
USPC ..... 222/386.5, 153.05–153.07, 81, 105, 222/153.01, 541.5, 541.2, 490, 464.1, 83
See application file for complete search history.

(56) References Cited

U.S. PATENT DOCUMENTS

| | | | |
|---|---|---|---|
| 2,608,320 | A | 8/1952 | Harrison, Jr. |
| 2,816,691 | A | 12/1957 | Ward |
| 2,889,078 | A | 6/1959 | Thomas |
| 2,891,700 | A | 6/1959 | Maynard |

(Continued)

FOREIGN PATENT DOCUMENTS

| | | |
|---|---|---|
| AT | 352609 | 9/1979 |
| AU | 632548 B2 | 1/1993 |

(Continued)

OTHER PUBLICATIONS

U.S. Appl. No. 61,334,005, filed May 12, 2010, Scharnick.

(Continued)

*Primary Examiner* — Donnell Long
(74) *Attorney, Agent, or Firm* — Entegris, Inc. Legal Dept.; Brian E. Szymanski; Catherine D. Gates

(57) ABSTRACT

The present disclosure, in one embodiment, relates to a dispenser including a dispense assembly having a head assembly, and also including a collapsible liner that contains a material to be dispensed, the liner detachably secured to the dispense assembly with the head assembly in fluid communication with the liner, wherein the material in the liner is dispensed out the liner and through the head assembly.

12 Claims, 10 Drawing Sheets

(56) References Cited

U.S. PATENT DOCUMENTS 3,270,920 A * 9/1966 Nessler ..... 222/95
3,275,193 A 9/1966 Barr
3,484,011 A 12/1969 Greenhalgh et al.
3,496,597 A 2/1970 Ayres
3,592,360 A 7/1971 Aleck
3,631,654 A 1/1972 Riely et al.
3,717,544 A 2/1973 Valyi
3,731,854 A 5/1973 Casey
3,802,470 A 4/1974 Coleman
3,813,198 A 5/1974 Valyi
3,900,635 A 8/1975 Funderburk, Jr. et al.
3,905,517 A 9/1975 Friedrich et al.
3,938,708 A 2/1976 Burger
3,966,378 A 6/1976 Valyi
3,981,415 A 9/1976 Fowler et al.
3,994,649 A 11/1976 Valyi
3,999,915 A 12/1976 Stepenske
4,008,830 A 2/1977 Meshberg
4,062,475 A 12/1977 Harris et al.
4,065,246 A 12/1977 Marcus
4,090,541 A 5/1978 Cammarata, III et al.
4,098,434 A 7/1978 Uhlig
4,138,036 A 2/1979 Bond
4,148,416 A 4/1979 Gunn-Smith
4,286,636 A 9/1981 Credle
4,322,020 A 3/1982 Stone
4,330,066 A 5/1982 Berliner
4,340,054 A 7/1982 Michaels
4,350,272 A 9/1982 Petterson
4,391,861 A 7/1983 Nilsson
4,423,829 A 1/1984 Katz
4,457,455 A 7/1984 Meshberg
4,469,250 A 9/1984 Evezich
4,476,272 A 10/1984 Pengilly
4,484,697 A 11/1984 Fry, Jr.
4,524,458 A 6/1985 Pongrass et al.
4,560,069 A 12/1985 Simon
4,578,295 A 3/1986 Jabarin
4,601,410 A 7/1986 Bond
4,641,765 A 2/1987 Diamond
4,690,295 A 9/1987 Wills
4,696,840 A 9/1987 McCullough et al.
4,796,788 A 1/1989 Bond
4,830,811 A 5/1989 Aoki
4,846,359 A 7/1989 Baird et al.
4,871,087 A 10/1989 Johnson
4,892,230 A 1/1990 Lynn, Jr.
4,893,731 A 1/1990 Richter
4,909,416 A 3/1990 Evezich
4,955,492 A 9/1990 Behm et al.
4,964,540 A 10/1990 Katz
4,966,207 A 10/1990 Howard et al.
5,012,956 A 5/1991 Stoody
5,027,952 A 7/1991 Kiplinger
5,035,339 A 7/1991 Meyersburg
5,046,638 A 9/1991 Wolf
5,049,349 A 9/1991 McCullough et al.
5,085,904 A 2/1992 Deak et al.
5,102,010 A * 4/1992 Osgar ..... B65D 47/36 222/1
5,102,705 A 4/1992 Yammoto et al.
5,108,007 A 4/1992 Smith et al.
5,111,971 A 5/1992 Winer
RE33,969 E 6/1992 Richter
5,143,294 A * 9/1992 Lintvedt ..... 239/328
5,186,361 A 2/1993 Williams
5,201,438 A 4/1993 Norwood
5,217,053 A 6/1993 Foster et al.
5,232,129 A 8/1993 Guerra
5,261,543 A 11/1993 Ugarelli
5,294,695 A 3/1994 Lee et al.
5,301,838 A 4/1994 Schmidt et al.
5,303,834 A 4/1994 Krishnakumar et al.
5,305,921 A 4/1994 Kock et al.
5,332,121 A 7/1994 Schmidt et al.
5,335,821 A 8/1994 Osgar
5,343,901 A 9/1994 Meshberg
5,344,045 A 9/1994 Richter et al.
5,368,195 A 11/1994 Pleet et al.
5,370,269 A 12/1994 Bernosky et al.
5,377,875 A 1/1995 Kock et al.
5,381,910 A 1/1995 Sugiura et al.
5,383,574 A 1/1995 Raphael
5,395,012 A 3/1995 Grill et al.
5,407,629 A 4/1995 Schmidt et al.
5,419,936 A 5/1995 Tindale
5,435,452 A 7/1995 Nishigami et al.
5,443,186 A 8/1995 Grill
5,443,766 A 8/1995 Slat et al.
5,443,767 A 8/1995 Cahill
5,447,678 A 9/1995 Kneer et al.
5,472,105 A 12/1995 Krishnakumar et al.
5,508,076 A 4/1996 Bright
5,513,761 A 5/1996 Kobayashi et al.
5,526,956 A 6/1996 Osgar
5,529,196 A 6/1996 Lane
5,529,744 A 6/1996 Tindale
5,556,675 A 9/1996 Yamamoto et al.
5,569,473 A 10/1996 Bright
5,628,957 A 5/1997 Collette et al.
5,645,183 A 7/1997 Slat et al.
5,647,930 A 7/1997 Bright
5,676,267 A 10/1997 Slat et al.
5,680,966 A 10/1997 Johnson
5,681,628 A 10/1997 Niederst et al.
5,693,017 A 12/1997 Spears et al.
5,704,503 A 1/1998 Krishnakumar et al.
5,746,350 A 5/1998 Nishigami et al.
5,749,493 A 5/1998 Boone et al.
5,749,500 A 5/1998 Kraus et al.
5,750,216 A 5/1998 Horino et al.
5,759,653 A 6/1998 Collette et al.
5,772,056 A 6/1998 Slat
5,804,016 A 9/1998 Schmidt et al.
5,804,305 A 9/1998 Slat et al.
5,827,164 A 10/1998 Tomic
5,873,478 A 2/1999 Sullivan et al.
5,875,921 A 3/1999 Osgar et al.
5,888,598 A 3/1999 Brewster et al.
5,908,128 A 6/1999 Krishnakumar et al.
5,915,596 A 6/1999 Credle, Jr.
5,921,416 A 7/1999 Uehara
5,925,710 A 7/1999 Wu et al.
5,927,525 A 7/1999 Darr et al.
5,934,457 A 8/1999 Ueda et al.
5,941,421 A 8/1999 Overman et al.
5,957,328 A 9/1999 Osgar
5,968,014 A 10/1999 Neftel et al.
5,971,184 A 10/1999 Krishnakumar et al.
5,976,653 A 11/1999 Collette et al.
5,979,713 A 11/1999 Grill
5,988,422 A 11/1999 Vallot
6,001,439 A 12/1999 Kawakami et al.
6,015,068 A 1/2000 Osgar et al.
6,027,438 A 2/2000 Frazier et al.
6,034,167 A 3/2000 Tung et al.
6,036,054 A 3/2000 Grill
6,042,635 A 3/2000 Chung et al.
6,045,006 A 4/2000 Frazier et al.
6,051,295 A 4/2000 Schloss et al.
6,065,638 A 5/2000 Terranova et al.
6,068,900 A 5/2000 Kohn et al.
6,073,807 A 6/2000 Wilford et al.
6,083,450 A 7/2000 Safian
6,112,925 A 9/2000 Nahill et al.
6,179,142 B1 1/2001 Hansen
6,179,173 B1 1/2001 Frazier et al.
6,203,870 B1 3/2001 Darr
6,206,240 B1 3/2001 Osgar et al.
6,223,932 B1 5/2001 Usui
6,228,447 B1 5/2001 Suzuki et al.
6,237,809 B1 5/2001 Kawai et al.
6,238,201 B1 5/2001 Safian
6,244,454 B1 6/2001 Yoshioka et al.

(56) References Cited

U.S. PATENT DOCUMENTS 6,253,936 B1 7/2001 Kong
6,254,820 B1 7/2001 Cornell
6,257,446 B1 7/2001 Pike
6,264,064 B1 7/2001 Birtcher et al.
6,267,132 B1 7/2001 Guarneri
6,296,803 B1 10/2001 Darr
6,305,577 B1 10/2001 Fillmore et al.
6,312,641 B1 11/2001 Hutchinson
6,345,739 B1 2/2002 Mekata
6,349,838 B1 2/2002 Saito et al.
6,412,668 B1 7/2002 Vlooswijk et al.
6,439,413 B1 8/2002 Prevot et al.
6,453,925 B1 9/2002 Kamo
6,460,404 B1 10/2002 Chan et al.
6,460,730 B1 10/2002 Liedtke
6,467,652 B2 10/2002 Wilcox et al.
6,510,965 B1 1/2003 Decottignies et al.
6,513,669 B2 2/2003 Ozawa et al.
6,542,848 B1 4/2003 Neeser et al.
6,544,459 B2 4/2003 Maruyama et al.
6,562,279 B2 5/2003 Slat
6,607,097 B2 8/2003 Savage et al.
6,609,636 B1 8/2003 Petriekis et al.
6,627,279 B2 9/2003 Hirota et al.
6,641,881 B1 11/2003 Darr
6,645,421 B1 11/2003 Sanderson et al.
6,648,201 B1 11/2003 Marinaro et al.
6,649,121 B1 11/2003 Hamamoto et al.
6,651,847 B2 11/2003 Mekata et al.
6,670,007 B1 12/2003 Safian et al.
6,672,479 B2 1/2004 Shiraishi et al.
6,679,439 B2 1/2004 Duqueroie
6,698,619 B2 3/2004 Wertenberger
6,702,978 B1 3/2004 Kuehn
6,719,173 B2 4/2004 Safian
6,720,047 B2 4/2004 Kikuchi et al.
6,732,945 B2 5/2004 Dolechek
6,749,780 B2 6/2004 Tobias
6,749,785 B2 6/2004 Subramanian et al.
6,752,297 B1 6/2004 Ische
6,808,820 B2 10/2004 Lee et al.
6,848,599 B2 2/2005 Hammarth et al.
6,851,579 B2 2/2005 Savage et al.
6,879,876 B2 4/2005 O'Dougherty et al.
6,926,859 B2 8/2005 Collette et al.
6,932,230 B2 8/2005 Pedmo et al.
6,938,788 B2 9/2005 White
6,938,836 B2 9/2005 Bouic
6,939,591 B2 9/2005 Hutchinson et al.
6,942,123 B2 9/2005 Wertenberger
6,942,127 B2 9/2005 Raats
6,945,428 B2 9/2005 Shimizu et al.
6,974,047 B2 12/2005 Kelley et al.
6,984,278 B2 1/2006 Anderson et al.
7,004,209 B2 2/2006 Davis et al.
7,022,058 B2 4/2006 Lee
7,025,234 B2 4/2006 Priebe et al.
7,029,752 B2 4/2006 Hama et al.
7,051,890 B2 5/2006 Onoda et al.
7,051,907 B2 5/2006 Brincat
7,094,863 B2 8/2006 Moore et al.
7,111,763 B2 9/2006 Masuda
7,172,096 B2 2/2007 O'Dougherty
7,188,644 B2 3/2007 Kelly et al.
7,188,785 B2 * 3/2007 Joseph ..... B05B 7/2408 239/302
7,191,910 B2 3/2007 Deemer et al.
7,195,129 B2 3/2007 Klemm
7,198,165 B2 4/2007 Zhang
7,201,291 B2 4/2007 Vigny et al.
7,204,950 B2 4/2007 Farha et al.
7,261,551 B2 8/2007 Hutchinson et al.
7,296,703 B2 11/2007 Lane
7,308,991 B2 12/2007 Alberg
7,316,329 B2 1/2008 Wertenberger
7,332,204 B2 2/2008 Hutchinson et al.
7,335,721 B2 2/2008 Alberg
7,357,276 B2 4/2008 Savage et al.
7,364,046 B2 4/2008 Joshi et al.
7,371,455 B2 5/2008 Shirane et al.
7,374,055 B2 5/2008 Hatcher et al.
7,377,399 B2 5/2008 Lane et al.
7,438,196 B2 10/2008 Yourist
7,455,189 B2 11/2008 Lane et al.
D582,722 S 12/2008 Peña
7,459,119 B2 12/2008 Ota et al.
7,481,336 B2 1/2009 Arghyris et al.
7,531,226 B2 5/2009 Lee et al.
7,544,405 B2 6/2009 Lepage
7,568,588 B2 8/2009 Yourist
7,588,808 B2 9/2009 Hutchinson et al.
7,607,823 B2 10/2009 Kent
7,681,783 B2 3/2010 Stephenson
7,713,464 B2 5/2010 Nakajima et al.
7,747,344 B2 6/2010 O'Dougherty et al.
7,810,664 B2 10/2010 Trude
7,810,679 B2 10/2010 Wauters et al.
7,833,466 B2 11/2010 Hirota et al.
7,845,522 B2 12/2010 Grill
7,857,157 B2 12/2010 Lane et al.
7,867,434 B2 1/2011 Iwahashi et al.
7,874,442 B2 1/2011 Nievierowski et al.
7,882,971 B2 2/2011 Kelley et al.
7,887,238 B2 2/2011 Turvey et al.
7,984,845 B2 7/2011 Kelly
7,988,897 B2 8/2011 Yamamoto et al.
8,017,063 B2 9/2011 Hutchinson et al.
8,038,039 B2 10/2011 Kelly et al.
8,052,012 B2 11/2011 Kelley et al.
8,074,839 B2 12/2011 Ronsin et al.
8,313,821 B2 11/2012 Yan et al.
8,322,571 B2 12/2012 Hovinen et al.
8,336,734 B2 12/2012 Ware et al.
9,132,205 B2 9/2015 Belmonte et al.
2001/0054597 A1 12/2001 Ozawa et al.
2002/0014275 A1 2/2002 Blatt et al.
2002/0022099 A1 2/2002 Schmidt et al.
2002/0048642 A1 4/2002 Beck
2002/0088767 A1 7/2002 Saito et al.
2002/0184945 A1 12/2002 Chase et al.
2003/0059130 A1 3/2003 Yoneyama et al.
2003/0075566 A1 4/2003 Priebe et al.
2003/0102335 A1 6/2003 Barnett
2003/0205285 A1 11/2003 Kelly et al.
2003/0205581 A1 11/2003 Wertenberger
2003/0211256 A1 11/2003 Tobias
2003/0218021 A1 11/2003 Shimizu et al.
2003/0222047 A1 12/2003 McRae
2004/0035880 A1 2/2004 Coleman et al.
2004/0056045 A1 * 3/2004 Kosmyna et al. ..... 222/95
2004/0058453 A1 3/2004 Free et al.
2004/0069347 A1 4/2004 Graves et al.
2004/0149348 A1 8/2004 Wertenberger
2004/0155008 A1 8/2004 Lane et al.
2004/0164047 A1 8/2004 White
2004/0188449 A1 9/2004 Thompson
2004/0217126 A1 11/2004 Lee
2004/0222238 A1 11/2004 Vigny et al.
2004/0245286 A1 * 12/2004 Lee ..... B65D 47/141 222/83
2005/0035083 A1 2/2005 Pedmo et al.
2005/0040181 A1 2/2005 Kurosawa et al.
2005/0087237 A1 4/2005 O'Dougherty et al.
2005/0103802 A1 5/2005 Alberg
2005/0121408 A1 6/2005 Deemer et al.
2005/0127105 A1 6/2005 Kay
2005/0129888 A1 6/2005 Kwon
2005/0140036 A1 6/2005 Hirota et al.
2005/0141788 A1 6/2005 Ikeda et al.
2005/0167433 A1 8/2005 Kuehn et al.
2005/0230418 A1 10/2005 Campbell et al.
2005/0247664 A1 11/2005 Lane et al.
2005/0279207 A1 12/2005 O'Dougherty et al.
2006/0030652 A1 2/2006 Adams et al.

(56) References Cited

U.S. PATENT DOCUMENTS

| | | | |
|---|---|---|---|
| 2006/0037968 | A1 | 2/2006 | Brenner |
| 2006/0054634 | A1 | 3/2006 | Mekata |
| 2006/0113319 | A1 | 6/2006 | Smith |
| 2006/0131258 | A1 | 6/2006 | Yourist |
| 2006/0131259 | A1 | 6/2006 | Hatcher et al. |
| 2006/0146103 | A1 | 7/2006 | Nakamura |
| 2006/0151425 | A1 | 7/2006 | Kelley et al. |
| 2006/0163292 | A1 | 7/2006 | Wauters et al. |
| 2006/0175433 | A1* | 8/2006 | Escoto ..... B05B 7/241 239/302 |
| 2006/0180568 | A1 | 8/2006 | Lane |
| 2006/0182911 | A1 | 8/2006 | Tammaji et al. |
| 2006/0186083 | A1 | 8/2006 | Joshi et al. |
| 2006/0196891 | A1 | 9/2006 | Gerson et al. |
| 2006/0207961 | A1 | 9/2006 | Kurtz |
| 2007/0007234 | A1 | 1/2007 | Tanaka et al. |
| 2007/0007307 | A1 | 1/2007 | Bohnisch et al. |
| 2007/0039917 | A1 | 2/2007 | Yourist |
| 2007/0039918 | A1 | 2/2007 | Lane et al. |
| 2007/0062907 | A1 | 3/2007 | Heisner |
| 2007/0075032 | A1 | 4/2007 | Kelley et al. |
| 2007/0090083 | A1 | 4/2007 | Trude |
| 2007/0104907 | A1 | 5/2007 | Nishioka et al. |
| 2007/0108668 | A1 | 5/2007 | Hutchinson et al. |
| 2007/0170144 | A1 | 7/2007 | Lane et al. |
| 2007/0272323 | A1 | 11/2007 | Verhaeghe |
| 2008/0009574 | A1 | 1/2008 | Huenefeld et al. |
| 2008/0010949 | A1 | 1/2008 | Lane et al. |
| 2008/0011879 | A1 | 1/2008 | Gerson et al. |
| 2008/0023887 | A1 | 1/2008 | Vollenberg et al. |
| 2008/0035519 | A1 | 2/2008 | Swartz et al. |
| 2008/0083696 | A1 | 4/2008 | Nievierowski et al. |
| 2008/0087628 | A1 | 4/2008 | Bangi et al. |
| 2008/0241447 | A1 | 10/2008 | Shi |
| 2008/0257846 | A1 | 10/2008 | Hove et al. |
| 2008/0258356 | A1 | 10/2008 | Van Hove et al. |
| 2008/0260978 | A1 | 10/2008 | Van Hove et al. |
| 2008/0272145 | A1 | 11/2008 | Nimmo et al. |
| 2008/0272154 | A1 | 11/2008 | Maas et al. |
| 2008/0298727 | A1 | 12/2008 | Edgington et al. |
| 2008/0310776 | A1 | 12/2008 | Turvey et al. |
| 2009/0001019 | A1 | 1/2009 | Frometa et al. |
| 2009/0020176 | A1 | 1/2009 | Hasegawa et al. |
| 2009/0030094 | A1 | 1/2009 | Yamane et al. |
| 2009/0057347 | A1 | 3/2009 | Leys et al. |
| 2009/0095701 | A1 | 4/2009 | Forsthovel |
| 2009/0108089 | A1 | 4/2009 | Handzel et al. |
| 2009/0127153 | A1 | 5/2009 | Kim |
| 2009/0212071 | A1 | 8/2009 | Tom et al. |
| 2009/0242044 | A1 | 10/2009 | Kranz et al. |
| 2009/0246428 | A1 | 10/2009 | Shimizu et al. |
| 2009/0261097 | A1 | 10/2009 | Yamamoto et al. |
| 2009/0283541 | A1 | 11/2009 | Compton et al. |
| 2010/0025430 | A1 | 2/2010 | Cisewski et al. |
| 2010/0072166 | A1 | 3/2010 | Dickie |
| 2010/0072167 | A1 | 3/2010 | Dickie |
| 2010/0112815 | A1 | 5/2010 | O'Dougherty et al. |
| 2010/0116707 | A1 | 5/2010 | Sasai et al. |
| 2010/0133292 | A1 | 6/2010 | Ware et al. |
| 2010/0163514 | A1 | 7/2010 | Human |
| 2010/0181280 | A1 | 7/2010 | Howell et al. |
| 2010/0200586 | A1 | 8/2010 | Furusawa |
| 2010/0206762 | A1 | 8/2010 | Sasai et al. |
| 2010/0227089 | A1 | 9/2010 | Van Hoven et al. |
| 2010/0239799 | A1 | 9/2010 | Van Hoven et al. |
| 2010/0330313 | A1 | 12/2010 | Van Hoven et al. |
| 2011/0024450 | A1 | 2/2011 | Maas et al. |
| 2011/0076432 | A1 | 3/2011 | Sakaguchi et al. |
| 2011/0108574 | A1 | 5/2011 | Nimmo et al. |
| 2011/0147406 | A1 | 6/2011 | Grill |
| 2011/0187028 | A1 | 8/2011 | Menning et al. |
| 2011/0210148 | A1 | 9/2011 | Nelson et al. |
| 2011/0226806 | A1 | 9/2011 | O'Dougherty et al. |
| 2012/0267388 | A1 | 10/2012 | Tom et al. |
| 2014/0001205 | A1 | 1/2014 | Hodges et al. |
| 2014/0374416 | A1 | 12/2014 | Tom et al. |

FOREIGN PATENT DOCUMENTS

| | | | |
|---|---|---|---|
| CN | 2558598 | Y | 7/2003 |
| CN | 101384492 | | 3/2009 |
| DE | 2103447 | | 8/1972 |
| DE | 10321339 | A1 | 12/2004 |
| EP | 0179538 | A2 | 4/1986 |
| EP | 194871 | | 9/1986 |
| EP | 0196344 | A1 | 10/1986 |
| EP | 0225677 | A2 | 6/1987 |
| EP | 0251812 | A2 | 1/1988 |
| EP | 276994 | | 8/1988 |
| EP | 0484771 | A1 | 5/1992 |
| EP | 0583953 | A1 | 2/1994 |
| EP | 0633122 | A1 | 1/1995 |
| EP | 0718213 | A1 | 6/1996 |
| EP | 0609348 | B1 | 1/1997 |
| EP | 0957030 | A2 | 11/1999 |
| EP | 1097899 | | 5/2001 |
| EP | 1240932 | | 9/2002 |
| EP | 1391416 | | 2/2004 |
| EP | 1626925 | B1 | 3/2007 |
| EP | 1803657 | A1 | 7/2007 |
| EP | 2148771 | B1 | 2/2010 |
| EP | 2152494 | B1 | 5/2011 |
| EP | 2366529 | A1 | 9/2011 |
| EP | 2388233 | | 11/2011 |
| ES | 2293791 | | 3/2008 |
| FR | 2126610 | | 10/1972 |
| FR | 2676958 | | 12/1992 |
| FR | 2895735 | | 7/2007 |
| FR | 2902083 | A1 | 12/2007 |
| FR | 2905116 | | 2/2008 |
| GB | 1560952 | | 2/1980 |
| GB | 1601424 | | 10/1981 |
| GB | 2353266 | A | 2/2001 |
| JP | 54-108412 | U1 | 7/1979 |
| JP | 56-013399 | | 2/1981 |
| JP | 57-125146 | | 8/1982 |
| JP | 57174221 | | 10/1982 |
| JP | 60021415 | | 2/1985 |
| JP | S60 070561 | U | 5/1985 |
| JP | 60099858 | | 6/1985 |
| JP | 61187271 | | 11/1986 |
| JP | 63049371 | | 4/1988 |
| JP | 63076653 | | 5/1988 |
| JP | H02-75366 | A | 3/1990 |
| JP | H0275366 | | 3/1990 |
| JP | 02208332 | | 8/1990 |
| JP | 04-063157 | A | 2/1992 |
| JP | H0463157 | | 2/1992 |
| JP | H04045275 | | 4/1992 |
| JP | 04110593 | | 9/1992 |
| JP | 5031791 | | 2/1993 |
| JP | 05103921 | | 4/1993 |
| JP | 5213373 | | 8/1993 |
| JP | 05319500 | | 12/1993 |
| JP | 5330535 | | 12/1993 |
| JP | 6039906 | | 2/1994 |
| JP | 0664073 | | 3/1994 |
| JP | 06286778 | | 10/1994 |
| JP | 7067792 | | 3/1995 |
| JP | 7257540 | | 10/1995 |
| JP | 8001761 | | 1/1996 |
| JP | 8192455 | | 7/1996 |
| JP | 8268470 | | 10/1996 |
| JP | 2586294 | | 2/1997 |
| JP | 09066228 | | 3/1997 |
| JP | 9208688 | | 8/1997 |
| JP | 10081354 | | 3/1998 |
| JP | 10095903 | | 4/1998 |
| JP | 10167243 | | 6/1998 |
| JP | 10180853 | | 7/1998 |
| JP | 10230919 | | 9/1998 |
| JP | 10287365 | | 10/1998 |

(56) References Cited

FOREIGN PATENT DOCUMENTS

| | | | |
|---|---|---|---|
| JP | 11011484 | | 1/1999 |
| JP | 11042697 | | 2/1999 |
| JP | 11153510 | | 6/1999 |
| JP | 11268744 | | 10/1999 |
| JP | 11268771 | | 10/1999 |
| JP | 2000/015082 | | 1/2000 |
| JP | 2000/062745 | | 2/2000 |
| JP | 2000/237642 | | 9/2000 |
| JP | 2000-237642 | A | 9/2000 |
| JP | 2001/062963 | | 3/2001 |
| JP | 2001-508698 | A | 7/2001 |
| JP | 2002/502778 | | 1/2002 |
| JP | 2002-502778 | A | 1/2002 |
| JP | 2002/145233 | | 5/2002 |
| JP | 2002/264944 | | 9/2002 |
| JP | 2003/040231 | | 2/2003 |
| JP | 2003/137197 | | 5/2003 |
| JP | 2003/252376 | | 9/2003 |
| JP | 2003/341681 | | 12/2003 |
| JP | 2004/051224 | | 2/2004 |
| JP | 2004/83138 | | 3/2004 |
| JP | 2005-506171 | A | 3/2005 |
| JP | 2005/088979 | | 4/2005 |
| JP | 2005/178390 | | 7/2005 |
| JP | 2005/524584 | | 8/2005 |
| JP | 2006/306478 | | 11/2006 |
| JP | 2006-306478 | A | 11/2006 |
| JP | 3845908 | | 11/2006 |
| JP | 2007/261608 | | 10/2007 |
| JP | 2009208818 | | 9/2009 |
| JP | 2010/511460 | | 4/2010 |
| JP | 4525922 | | 8/2010 |
| JP | 533503 | | 7/2013 |
| KR | 10/0385555 | | 5/2003 |
| KR | 10/0438101 | | 6/2004 |
| KR | 2004/46283 | | 10/2009 |
| TW | 197995 | B | 1/1993 |
| TW | 272216 | | 2/2007 |
| WO | WO 91/08099 | | 6/1991 |
| WO | WO 91/08100 | | 6/1991 |
| WO | WO 91/10604 | | 7/1991 |
| WO | WO 91/13003 | | 9/1991 |
| WO | WO 93/14987 | | 8/1993 |
| WO | WO 93/24392 | | 12/1993 |
| WO | WO 95/03245 | | 2/1995 |
| WO | WO 96/01226 | | 1/1996 |
| WO | WO 99/39990 | | 8/1999 |
| WO | WO 99/43571 | | 9/1999 |
| WO | WO 00/34023 | | 6/2000 |
| WO | WO 00/54724 | | 9/2000 |
| WO | WO 02/47988 | A1 | 6/2002 |
| WO | WO 03/093109 | A1 | 11/2003 |
| WO | WO 03/093141 | A1 | 11/2003 |
| WO | WO 2004/050537 | A2 | 6/2004 |
| WO | WO 2005/023660 | A1 | 3/2005 |
| WO | 2005100203 | | 10/2005 |
| WO | WO 2006/116428 | A2 | 11/2006 |
| WO | WO 2006/116572 | A2 | 11/2006 |
| WO | WO 2006/133026 | A2 | 12/2006 |
| WO | WO 2007/061967 | A2 | 5/2007 |
| WO | WO 2007/088661 | A1 | 8/2007 |
| WO | 2007146892 | | 12/2007 |
| WO | WO 2008/000574 | A1 | 1/2008 |
| WO | WO 2008/022605 | A1 | 2/2008 |
| WO | WO 2008/068486 | A2 | 6/2008 |
| WO | WO 2008/077468 | A1 | 7/2008 |
| WO | WO 2009/041809 | A1 | 4/2009 |
| WO | 2009076101 | | 6/2009 |
| WO | WO 2009/076276 | A2 | 6/2009 |
| WO | WO 2009/088285 | A1 | 7/2009 |
| WO | WO 2009/154446 | A1 | 12/2009 |
| WO | WO 2010/031764 | A2 | 3/2010 |
| WO | 2010047800 | A2 | 4/2010 |
| WO | WO 2010/044659 | A1 | 4/2010 |
| WO | WO 2010/064749 | A1 | 6/2010 |
| WO | 2011006146 | | 1/2011 |
| WO | WO 2011/002294 | A2 | 1/2011 |
| WO | 2011046802 | | 4/2011 |
| WO | 2012051093 | | 4/2012 |
| WO | WO 2012/051496 | A2 | 4/2012 |
| WO | 2012118527 | | 9/2012 |
| WO | WO 2012/135266 | A2 | 10/2012 |

OTHER PUBLICATIONS

U.S. Appl. No. 61/448,172, filed Mar. 1, 2011, Ware et al.
U.S. Appl. No. 61/468,832, filed Mar. 29, 2011, Dubois et al.
U.S. Appl. No. 61/525,540, filed Aug. 19, 2011, Ware et al.
U.S. Appl. No. 61/556,943, filed Nov. 8, 2011, Chism et al.
International Search Report and Written Opinion for related PCT application PCT/US2011/061771, mailed Jul. 30, 2012 (7 pgs.).
International Search Report and Written Opinion for related PCT application PCT/US2011/061764, mailed May 14, 2012 (7 pgs.).
Cascio, S.J. et al. "Low Pressure Liquid Dispense System", IBM Technical Disclosure Bulletin, vol. 20, No. 1, June c:: 1977 (pp. 126-127).
Mykrolis "Fluorogard AT and ATX Disposable Filters" (2004).
"Burple". Retroland, Inc., 2003-2011. Retrieved from Internet Nov. 27, 2012 URL: <http://www.retroland.com/burple/> (3 pp.).
"Cheertainer Bag in Box". CDF Corporation, 2012. Retrieved from Internet Dec. 4, 2012 URL:<http://www.cdfl.com/cheertainer.php> (2 pp.).
Ophir, A. et al "Hot Fillable Containers Containing PET/Pen Copolymers and Blends", 2004. Retrieved from Internet Dec. 4, 2012. URL: <http://www.isplrc.co.il/images/calc/HighTempPET.doc> (20 pp.).
Hudson, Benjamin S. "The effect of liquid hot filling temperature on blow-molded Hope bottle properties", Dec. 2008. Retrieved from Internet Dec. 4, 2012 URL: <http://contentdm.lib.byu.edu/cdm/ref/collection/ETD/id/1628> (154 pp.).
U.S. Appl. No. 13/382,743, filed Jul. 9, 2012, inventor Glenn Tom.
Taiwan Search Report of TW Patent Appl. No. 100142753 dated Jul. 14, 2016.

* cited by examiner

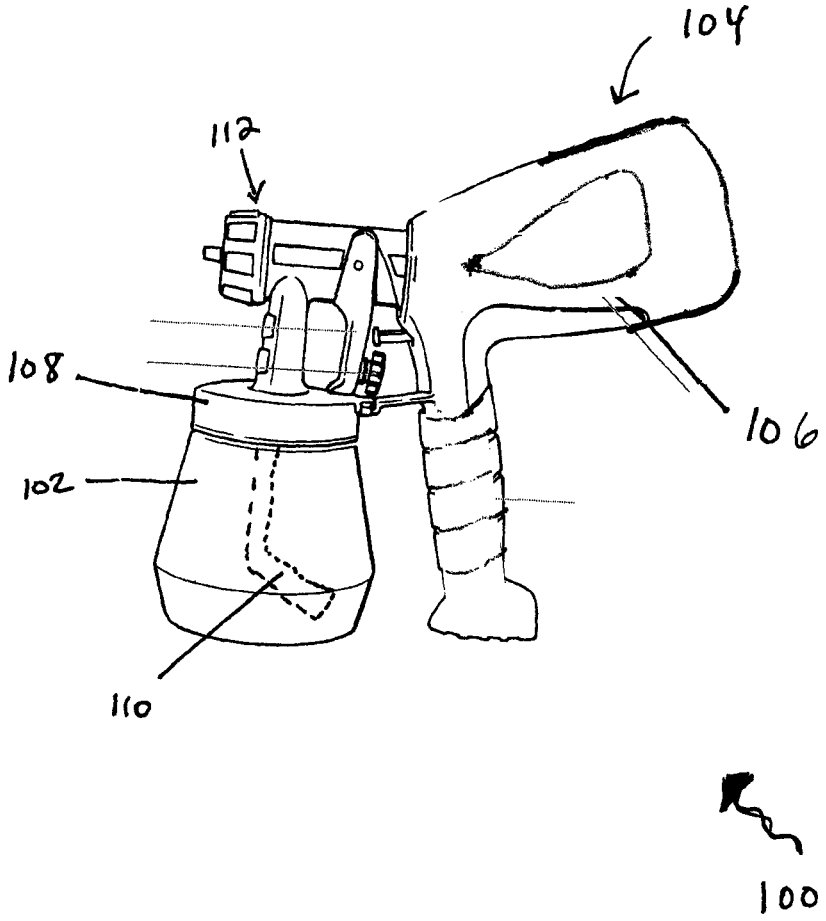
FIG. 1 -Prior Art

LINER-BASED DISPENSER

FIELD OF THE INVENTION

The present disclosure relates generally to a sprayer or dispenser. More particularly, in one embodiment, the present disclosure relates to dispensers that comprise or include a flexible liner or a rigid collapsible liner that contains the material to be dispensed, wherein the liner may be disposed of and/or recycled after use.

BACKGROUND OF THE INVENTION

The use of a dispensing or spraying apparatus to apply a chemical or other material to a surface or area is well known. For example, a sprayer may be used to apply, for example, pesticides, fertilizers, cleaning solutions, paint, or other chemicals to a desired area. The use of a sprayer to apply materials to a desired area may allow large areas to be covered or coated relatively quickly and uniformly at any thickness desired. Typically, a sprayer includes a fluid reservoir, a pump, a dip tube and a spray head. The fluid reservoir of the sprayer is usually filled with the desired material, and the pump and spray head are connected in some fashion to the fluid reservoir container. Pouring the desired material into the fluid reservoir from its original container may result in a loss of material, which in some cases could be relatively expensive. Further, the material being transferred to the sprayer may degrade as it comes into contact with the environment. Finally, in cases where the material being transferred is noxious or harmful, the user must assume the risks of being exposed to the material during transfer.

After the sprayer has been used, the sprayer must be cleaned to prevent clogging, contamination, corrosion, etc. All of the areas of the sprayer that come into contact with the sprayed material, such as the fluid reservoir, the dip tube and the spray head must be cleaned before the sprayer can be properly used again. Cleaning the sprayer after use is time consuming and/or expensive. Further, depending on what material is contained in the fluid reservoir, cleaning the dispenser may expose the user doing the cleaning to harmful chemicals or substances. The more parts of the dispenser that need to be cleaned after use, the greater the risk that the user will come into contact with the substance contained in the dispenser.

Accordingly, a need exists for a dispenser that does not require a user to pour the desired chemical or other material from the container initially holding the material into the fluid reservoir of the dispenser. Additionally, a need exists for a dispenser that does not require extensive cleaning of all of its components prior to reuse.

BRIEF SUMMARY OF THE INVENTION

The present disclosure relates to a dispenser that has a dispense assembly. The dispense assembly has a dispense mechanism, a connector/cover, and a head assembly. The dispenser also has a liner that contains a material to be dispensed, wherein the liner is detachably secured to the dispense assembly connector/cover, and wherein the material in the liner is dispensed out of the liner and through the head assembly of the dispense assembly by the dispense mechanism.

The present disclosure, in one embodiment, relates to a dispenser including a dispense assembly having a head assembly, and also including a collapsible liner that contains a material to be dispensed, the liner detachably secured to the dispense assembly with the head assembly in fluid communication with an interior of the liner, wherein the material in the liner is dispensed out the liner and through the head assembly. In some embodiments, the dispenser may include a diptube operably connected with the dispense assembly and in fluid communication with the material to be dispensed. The material to be dispensed may be dispensed by pumping the material from the liner, through the diptube, and to the head assembly. In another embodiment, the dispense assembly may be operably coupled with a dispense mechanism, the dispense assembly and dispense mechanism causing dispense of the material to be dispensed by introducing a fluid or gas into the liner, thereby forcing the material in the liner out of the liner and to the head assembly. In still another embodiment, the dispense assembly may comprise a dispense mechanism, the dispense mechanism causing dispense of the material to be dispensed by introducing a fluid or gas into the liner, thereby forcing the material in the liner out of the liner and to the head assembly. In further embodiments, the dispenser may include an overpack that holds the liner and that detachably secures to the dispense assembly. In some embodiments including an overpack, the dispense assembly may be operably coupled with a dispense mechanism, the dispense assembly and dispense mechanism causing dispense of the material to be dispensed by introducing a fluid or gas into an annular space between the liner and the overpack, thereby causing the liner to collapse and forcing the material in the liner out of the liner and to the head assembly. The dispense mechanism could be remote from the dispense assembly. In yet further embodiments including an overpack, the dispense assembly may comprise a dispense mechanism, the dispense mechanism causing dispense of the material to be dispensed by introducing a fluid or gas between into an annular space between the liner and the overpack, thereby causing the liner to collapse and forcing the material in the liner out of the liner and to the head assembly. The head assembly may have a nozzle in fluid communication with an interior of the liner. In some embodiments, the liner could be manufactured from recyclable material. In further embodiments, the liner may include a fitment having a closure seal providing secure containment of the materials to be dispensed. The closure seal could be resealable. The fitment may include mating features for detachably securing the liner to the dispense assembly. In various embodiments, the dispenser may further include a second collapsible liner that contains a different material to be dispensed, the second liner detachably secured to the dispense assembly with the head assembly in fluid communication with the second liner, wherein upon dispense of the materials of the collapsible liner and the second collapsible liner, the materials thereof are mixed.

The present disclosure, in another embodiment, relates to a method for portable dispense of contents of a liner. The method may include detachably connecting a portable dispense assembly, having a dispense mechanism and a head assembly, to a collapsible liner, with the head assembly in fluid communication with an interior of the liner, the liner containing a material to be dispensed. The method may also include causing the dispense mechanism to introduce a fluid or gas into the liner, thereby forcing the material in the liner out of the liner and to the head assembly.

The present disclosure, in yet another embodiment, relates to a method for portable dispense of contents of a liner. The method may include detachably connecting a portable dispense assembly, having a dispense mechanism and a head assembly, to an overpack and collapsible liner assembly, with the head assembly in fluid communication with the liner, the liner containing a material to be dispensed. The method may also include causing the dispense mechanism to introduce a fluid or gas into an annular space between the liner and the overpack, thereby causing the liner to collapse and forcing the material in the liner out of the liner and to the head assembly. In some cases, the dispense may be controlled by a timer-controlled valve or may be triggered by sensing an external event.

The present disclosure, in still another embodiment, relates to a containment system including a head assembly operably connected with a portable vacuum source, a liner for receiving a material vacuumed via the head assembly, the liner detachably secured to the head assembly and in fluid communication with an interior of the liner, and an overpack that holds the liner and that detachably secures to the head assembly. The liner may include a fitment having a closure seal providing secure containment of the materials received by the liner. The closure seal may be resealable. In some embodiments, the containment system may include a neutralizing agent for neutralizing the material received.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

FIG. 1 shows a prior art sprayer.

DETAILED DESCRIPTION

Figure 2A:
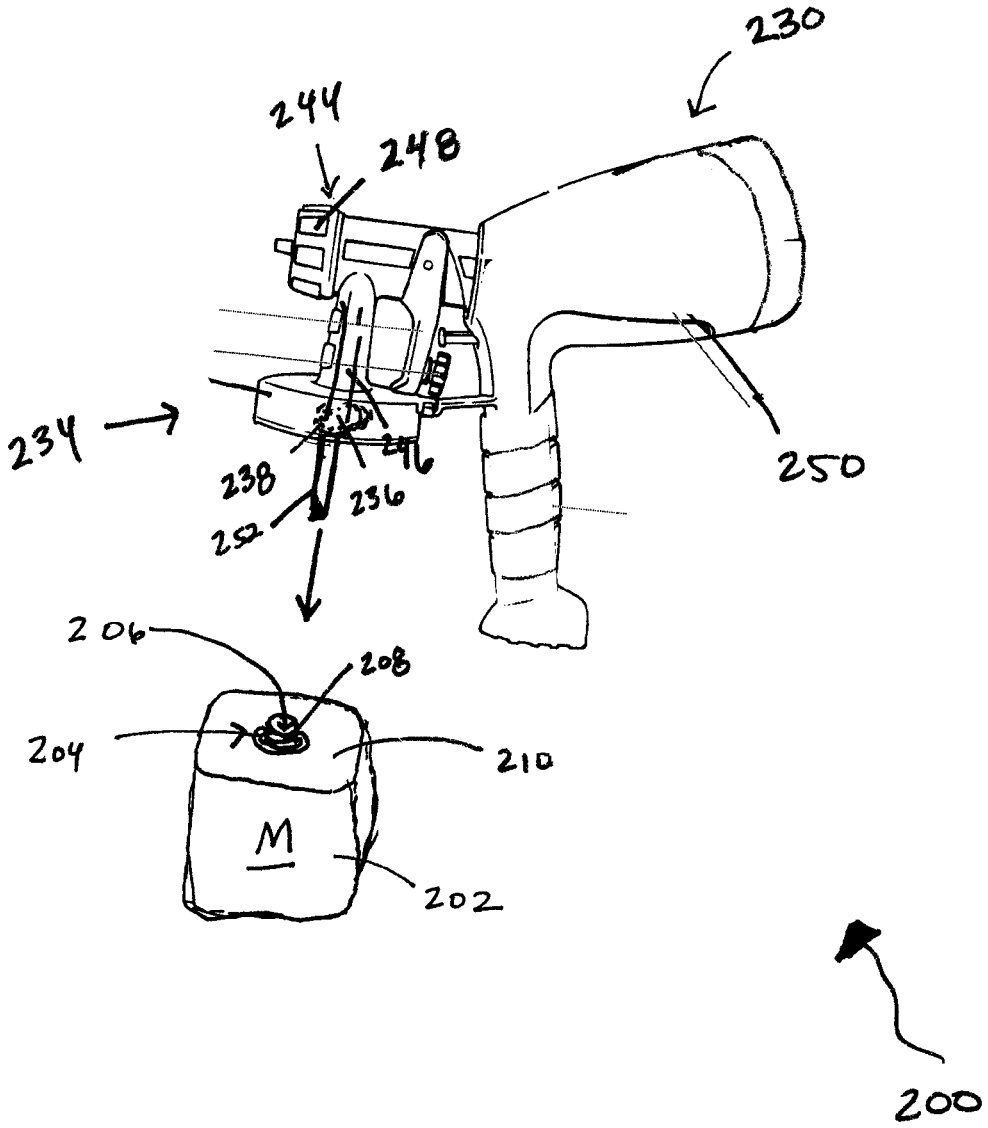
FIG. 2A shows the elements of a liner-based dispenser, according to one embodiment of the present disclosure.

The present disclosure relates to novel and advantageous sprayers or dispensers. More particularly, the present disclosure relates to a dispenser that comprises or includes a flexible liner or a rigid collapsible liner that contains the material to be sprayed or dispensed. In some embodiments, the flexible liner may be recycled and/or disposed of after use, thereby eliminating the need to clean the fluid reservoir of the sprayer or dispenser after use. Embodiments of the present disclosure may be used with a variety of fluids in a variety of different industries. Liners of the present disclosure may contain, for example, but are not limited to: pesticides/fertilizers; paints/glosses/solvents/coating-materials etc.; power washing fluids; lubricants for use in the automobile or aviation industry, for example; food products, such as condiments, for example; or any other material that may be dispensed by pump dispense or pressure dispense, for example. Materials that may be used with embodiments of the present disclosure may have any viscosity, including high viscosity and thin viscosity fluids.

FIG. 1 shows a typical embodiment of a conventional sprayer 100. The sprayer 100 may include a fixed fluid reservoir 102 and a dispense assembly 104. The dispense assembly may include a pump 106, a cover/connector 108, a dip tube 110, and a spray head 112. The fixed fluid reservoir 102 may be detachably removed from the cover/connector of the dispense assembly 104. Typically, the material to be sprayed is poured directly into the fixed fluid reservoir 102. Particularly, the material to be sprayed is usually purchased in a separate container that must be opened and poured into the fixed fluid reservoir 102, thereby exposing the material to air and/or UV light. Light and air exposure may be harmful, and in some cases substantially harmful, to some chemicals or materials. Further, the process of pouring the material into the fixed fluid reservoir 102 may expose the user to noxious fumes or odors. Additionally, there is a risk that the material may be spilled, which may damage or destroy what was spilled upon, in addition to losing the spilled material, which in some instances can be relatively expensive. Before the sprayer 100 may be used again with a different material, the sprayer 100 must be cleaned so that the new material is not contaminated with the old material. Cleaning the sprayer 100 shown in FIG. 1 includes cleaning the fixed reservoir 102, the dip tube 110, the cover/connector 108, and the spray head 112, as the sprayed material would have made contact with each of these sprayer 100 elements.

In contrast to the sprayer shown in FIG. 1, in one embodiment of the present disclosure, as shown in FIG. 2A, a sprayer 200 may comprise a disposable/recyclable liner 202 and a dispense assembly 230 that may be detachably secured to the liner 202. The liner 202 may be filled with the material M that is to be sprayed. In some embodiments, the material M may be sold in the liner 202 so that the user need only connect the liner 202 to the pump assembly 230, thereby avoiding the problems and risks associated with transferring the material from its original container to the fluid reservoir.

In some embodiments, the liner 202 may be a collapsible liner that may be flexible, while in other embodiments the liner may be somewhat rigid but still collapsible, i.e. a rigid collapsible liner. The liner 202 may be manufactured using any suitable material or combination of materials, for example but not limited to, one or more polymers, including plastics, nylons, EVOH, polyolefins, or other natural or synthetic polymers. In further embodiments, the liner 202 may be manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). In some embodiments, the material or materials selected and the thickness of that material or those materials may determine the rigidity of the liner 202. The liner 202 may have one or more layers and may have any desirable thickness. A liner 202 may have a thickness of, for example, from about 0.05 mm to about 3 mm, or any other suitable thickness. As used here and throughout the present disclosure, ranges are used as a short hand for describing each and every value that is within the range; any value within the range can be selected as the terminus of the range.

Figure 2B:
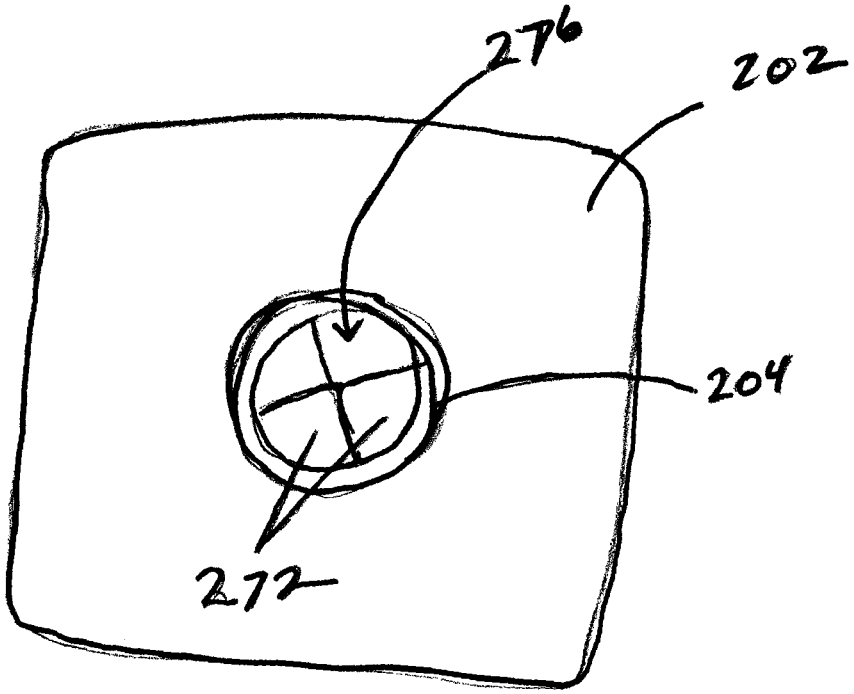
FIG. 2B shows top view of one embodiment of a seal for a liner, according to one embodiment of the present disclosure.

The liner 202 may also have a fitment 204 that may be integral with the liner 202. The fitment 204 may be comprised of a thicker material than the rest of the liner. The fitment 204 may contain a closure seal 206 such that the material M in the liner 202 may be securely contained until dispense. The closure seal 206 may be removed prior to connecting the liner 202 to the dispense assembly 230. Any suitable method of removing all or a portion of the closure seal 206 may be used. For example, a pull tab may be used to remove the closure seal 206, in one embodiment. In another embodiment, the closure seal 206 may be pierced, punctured, or pushed through prior to attaching the dispense assembly 230 to the dispenser 200 for dispense. As may be seen in FIG. 2B, in yet another embodiment, the seal 206 may be a reclosable seal 276 that may automatically close when the liner 202 is removed from the dispense assembly 230. A reclosable seal 276 may advantageously limit or substantially eliminate the exposure of any remaining material to the environment when the dispense assembly 230 is removed from the liner 202. In one embodiment, the reclosable seal 276 may comprise a membrane that has a plurality of flanges 272, for example, that may bend inward when the dispense assembly 230 is attached to the liner 202. When the dispense assembly 230 is removed from the liner 202, the flanges 272 may return to their original closed position. Any suitable number of flanges, including one or more flanges, may be used. In another embodiment, a removable seal may cover a reclosable seal. While one method of providing a reclosable has been described, it will be understood that any suitable means of providing a reclosable seal may be used.

The liner 202 may also have connecting features for coupling the liner 202 to the dispense assembly 230. For example, the fitment 204 may have threads 208 that may couple to complimentary threads on the connector/cover 234 of the dispense assembly 230, or the fitment 204 of the liner 202 may attach to the connector/cover 234 of the dispense assembly 230 by snap-fit or any other suitable means. Alternatively, the top panel 210 of the liner 202 may have securing features for coupling to the connector/cover 234 of the dispense assembly, such as complimentary threads, or snap-fit features for example. In still another embodiment, the connector/cover 234 may include a cage-like frame that the liner 202 may be placed into, whereby the liner 202 may be secured to the connector/cover 24 of the dispense assembly 230 by any suitable means.

In one embodiment, the liner 202 and overpack in some embodiments, may be configured or adapted for connection with existing or traditional dispense assemblies. In other embodiments of the system, which for example may be purchased as a complete system, may be provided with the dispense assembly, and in some cases with the dispense assembly already attached to the liner and/or overpack.

In some embodiments, the dispense assembly 230 may comprise: a connector/cover 234; a head 244 that may include a dispense channel 246 and a nozzle assembly 248; and a dispense mechanism 250. As discussed above, the connector/cover 234 may be detachably secured to the liner 202 via connecting features, for example threads 238 on the connector/cover 234 that mate with complimentary threads 208 on the fitment 204 of the liner 202. In other embodiments, however, the connector/cover 234 of the dispense assembly 230 may connect to the liner 202 by any suitable means, such as, for example, snap fit, locking hinges, or any other suitable method or combination of methods. The cover 234 may also comprise a dispense opening 236 for the material M in the liner 202 to flow through the dispense channel 246 and out of the head 244 of the dispense assembly 230. In one embodiment, the dispense opening 236 may include connecting features that couple with connecting features on the fitment 204 of the liner 202.

In some embodiments, the connector/cover 234 of the dispense assembly 250 may also include a dip tube 252 that is integral with the connector/cover 234 and extends into the liner 202 through the liner fitment 204, for example. In other embodiments, the connector/cover 234 of the dispense assembly 250 may have features for detachably securing a dip tube 252 to the connector/cover 234 (such as complimentary threading, snap-fit, or any other suitable mechanism for connecting to the dip tube), such that the dip tube may be discarded/recycled after use along with the liner, thereby avoiding the necessity of cleaning the dip tube.

The dispense mechanism 250 of the dispense assembly 230 in one embodiment may include a pump dispense mechanism, whereby the material M is drawn out of the liner 202 through the dip tube 252 that may extend from the cover 234 of the dispense assembly 230 through the fitment 204 of the liner (once the seal 206 is removed or moved to an open position) and into the liner 202 compartment. During pump dispense, the liner 202 may collapse in upon itself as the material M in the liner 202 is drawn out of the liner. The collapsing action of the liner 202 may help facilitate substantially complete dispense of the material M in the liner 202.

In other embodiments, the dispense mechanism 250 of the dispense assembly 230 may comprise a pressure dispense mechanism, whereby a substance, for example, a fluid, gas, or any other suitable substance, may be directed into the liner 202, thereby forcing the material M of the liner 202 out of the dispense channel 246 and head 244 of the dispense assembly 250. In such embodiments, the cover 234 of the dispense assembly 230 may include an inlet channel that permits the fluid, gas, or other substance to be pumped into the liner 202. Because the use of pressure dispense eliminates the use of a pump, issues associated with pump dispense are eliminated, such as, for example, pump clogging, pump clean-up, and/or pump replacement/rebuilds. The pressure dispense mechanism may provide for variable rates of dispense, including controlled periodic bursts, continuous spray, continuous flow (for use with condiments such as ketchup, or other appropriate materials, for example), or any other suitable method of dispense. With any type of dispense, the packaging systems of the present disclosure may be configured to dispense at any orientation, including inverted dispensing orientations.

In some embodiments, a dispenser may include more than one liner that may contain different materials. By way of example, one liner may contain a dark blue colored paint and another liner may contain a light purple colored paint. The dispense assembly may include a connector/cover that may connect to or align with the fitments of each of the liners. Alternatively, one liner may comprise two or more compartments that may contain different materials. When the sprayer is activated to spray mode, the dispense assembly may draw the material from both of the liners and may mix the material in the sprayer head, for example, such that the resulting material that is sprayed out of the sprayer may be a mixture of the contents of all or some of the liners. In addition to saving time, such a feature is advantageous because it does not require a user to be subjected to potentially noxious fumes or odors during mixing. This embodiment may also be advantageously used with applications of coatings that may be unstable and require a catalyst to cure where one liner may contain the coating and another liner may contain the catalyst, thereby allowing a mixture of both to be applied. In multiple liner embodiments, the ratio of the material of each liner that is included in the mixture may be controlled by a variety of means, for example, by varying the pressure or by varying the size of the nozzle, or any other suitable method or combination of methods.

In some embodiments, the nozzle may include a mechanism that may help partially cure the material as it is being dispensed. This may be achieved by any suitable means, or combination of means, for example, but not limited to, an ultraviolet light, an infrared light, and/or a small heater that may be included in the nozzle of a dispense assembly.

Cleaning the sprayer 200 shown in FIG. 2 may only include cleaning the head 244 and the dispense channel 246 because the liner 202 may be discarded/recycled after use. In some cases, a liner 202 may be provided that contains a cleaning solution that can be sprayed or dispensed from the sprayer 200 in order to relatively quickly and easily clean the head 244 and dispense channel 246 of the dispense assembly 230.

Figure 3:
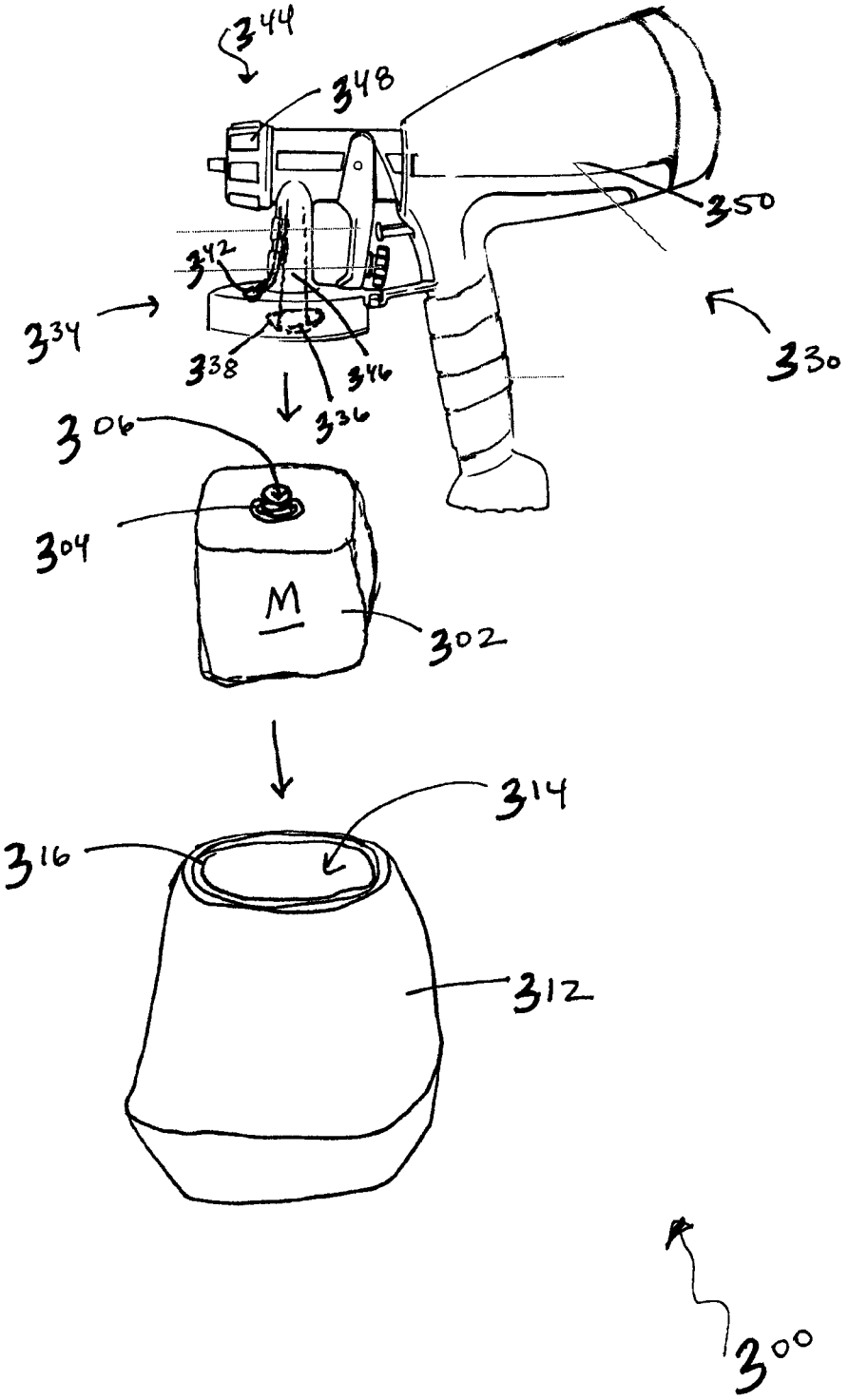
FIG. 3 shows the elements of a liner-based dispenser that includes an overpack, according to one embodiment of the present disclosure.

In another embodiment of a sprayer/dispenser of the present disclosure, as shown in FIG. 3, an overpack 312 may be used with a liner 302 and dispense assembly 330 such as those described above. As shown in FIG. 3, the liner 302 may be placed inside of the overpack 312. The overpack 312, and in some embodiments the overpack 312 and the liner 302, may be connected to the connector/cover 334 of the dispense assembly 330. In some embodiments, the overpack 312 may be a standard fixed reservoir such as those already used with known sprayers, while in other embodiments, the overpack 312 may be manufactured specifically for use with embodiments of the present disclosure. The overpack 312 may take any desired shape and may be comprised of any suitable relatively rigid material. For example, the overpack 312 may be comprised of plastic, metal, wood, corrugated cardboard, composites, glass, or any other suitable material, or combination of materials, including any of the materials or combination of materials listed above with respect to the liner 202. The overpack 312 and liner 202 need not be manufactured from the same materials. The overpack 312 may have an opening 314 into which the liner 302 may be placed. The overpack 312 may also have a rim 316 comprising features for connecting the overpack 312 to the dispense assembly 330. In some embodiments, for example, the rim 316 may comprise threads that may mate with complimentary threads on the connector/cover 334 of the dispense assembly 330. In other embodiments, the connecting features may comprise any suitable method for securing the dispense assembly 330 to the overpack 312, for example.

Liners according to embodiments of the invention may be free-standing and used in a manner similar to that of conventional rigid-wall containers, for example glass bottles. In another embodiment, the liner may be freestanding during filling, transportation, and storage. That is, an outer container is not necessary for support of the liner as with liners in conventional collapsible liner-based systems. In one embodiment, the liner may be a free-standing container system. The liner is substantially self-supporting in an expanded state, according to one embodiment, but collapsible at a pressure less than about 20 psi to dispense fluid from within the interior cavity. Additionally, in one embodiment, a wall of the liner may be from about 0.05 mm to about 3 mm thick, from about 0.2 mm to about 1 mm thick, from about 0.1 mm to about 1 mm thick, or from about 0.15 mm to about 0.6 mm thick, from about 0.15 to about 0.3 millimeter thick, or about 0.25 millimeter thick. While the thickness of the liner wall can provide rigidity to the liner, the thickness is selected so that, when a specified amount of pressure or vacuum is applied to the liner, the liner wall is collapsible to dispense liquid from within an interior cavity of the liner. In one embodiment, the dispensability of the liner may be controlled based on the thickness selected for the liner wall. In some embodiments of the present disclosure, a substantially rigid collapsible liner may obtain above 90% dispensability, desirably above 97% dispensability, and more desirably up to 99.9% dispensability or up to about 99.95% dispensability, depending on the thickness of the liner wall, the material used for the liner, and the design of any folds in the liner.

As indicated above, the liner 202 may be configured to comprise any desirable shape that is appealing to the user, and/or assists in the collapse of the liner. The liner 202, in some embodiments, may be dimensioned and shaped to substantially conform to the interior of the overpack 312. As such, the liner 202 may have a relatively simplistic design with a generally smooth outer surface, or the liner may have a relatively complicated design including, for example but not limited to, indentations and/or protrusions. In some embodiments, the liner wall may include a generally textured surface in order to minimize adhesion. For example, in some embodiments, the surface may include a plurality of bumps, scales, or projections, which may each have any appropriate size, for example, but not limited to, from about 0.5-100 Texturizing features may be spaced any suitable distance from one another. In some embodiments, the texturizing may comprise a framework, such as a lattice or scaffold, for example. Examples of some suitable texturizing features are described in greater detail in U.S. Provisional Patent Appln. No. 61/334,005, titled, "Fluid Processing Components with Textured Surface for Decreased Adhesion and Related Methods," filed May 12, 2010, which is hereby incorporated by reference herein in its entirety. The liner 202 may have a relatively thin liner wall, as compared to the thickness of the overpack wall. In some embodiments, the liner 202 may be flexible such that the liner wall may be readily collapsed, such as by vacuum through the mouth or by pressure between the liner 202 and overpack 312, referred to herein as the annular space therebetween.

The liner 202, in a further embodiment, may have a shape, when inflated or filled, that is different from, but complimentary with, the shape of the overpack 312 such that it may be disposed therein. In some embodiments, the liner 202 may be removably attached to the interior of the overpack wall. The liner 202 may provide a barrier, such as a gas barrier, against drive gas migration from the annular space between the liner 202 and the overpack 312. Accordingly, the liner 202 may generally ensure and/or maintain the purity of the contents within the liner.

In some embodiments, particularly where sterility of the contents of the liner must be substantially maintained, the liner 202 may be comprised of a material that may help ensure or maintain a sterile environment for the contents disposed in the liner. For example, in some embodiments the liner may be comprised of TK8 manufactured by ATMI of Danbury, Conn., or any other suitable material. As noted above, in some embodiments, the liner 202 may comprise multiple layers. The multiple layers may comprise one or more different polymers or other suitable materials. In some embodiments, the thickness, ply, and/or the composition of the liner and/or the layers of the liner may allow for the secure and substantially uncontaminated shipment of the contents of the liner-based system of the present disclosure by limiting or eliminating typical weaknesses or problems associated with traditional liners or packages, such as, for example weld tears, pin holes, gas entrainment, and/or any other means of contamination. Similarly, or in addition, the liner 202 may also contribute to the secure and substantially uncontaminated shipment of the contents of the dispense system of the present disclosure by configuring the liner to substantially conform to the shape of the overpack when the liner is filled, thereby reducing the amount of movement of the contents during shipping. Further, in embodiments where the liner substantially conforms to the shape of the overpack, the amount of movement of the liner during shipment may be reduced or substantially reduced, advantageously reducing or eliminating the occurrence of pin holes.

The overpack 312 and liner 202 may each be manufactured using any suitable manufacturing process, for example but not limited to, welding or blow molding, including extrusion blow molding, injection blow molding, stretch blow molding and/or reheat and blow molding, or any other suitable process, and may each be manufactured as a single component or may be a combination of multiple components. In some embodiments, the overpack 312 and liner 202 may be blow molded in a nested fashion, also referred to herein as co-blow molded. Examples of liner-based systems and methods utilizing co-blow molding techniques have been described in greater detail in International PCT Appl. No. PCT/US11/55560, titled, "Nested Blow Molded Liner and Overpack and Methods of Making Same," filed Oct. 10, 2011, which is hereby incorporated herein by reference in its entirety.

Figure 8:
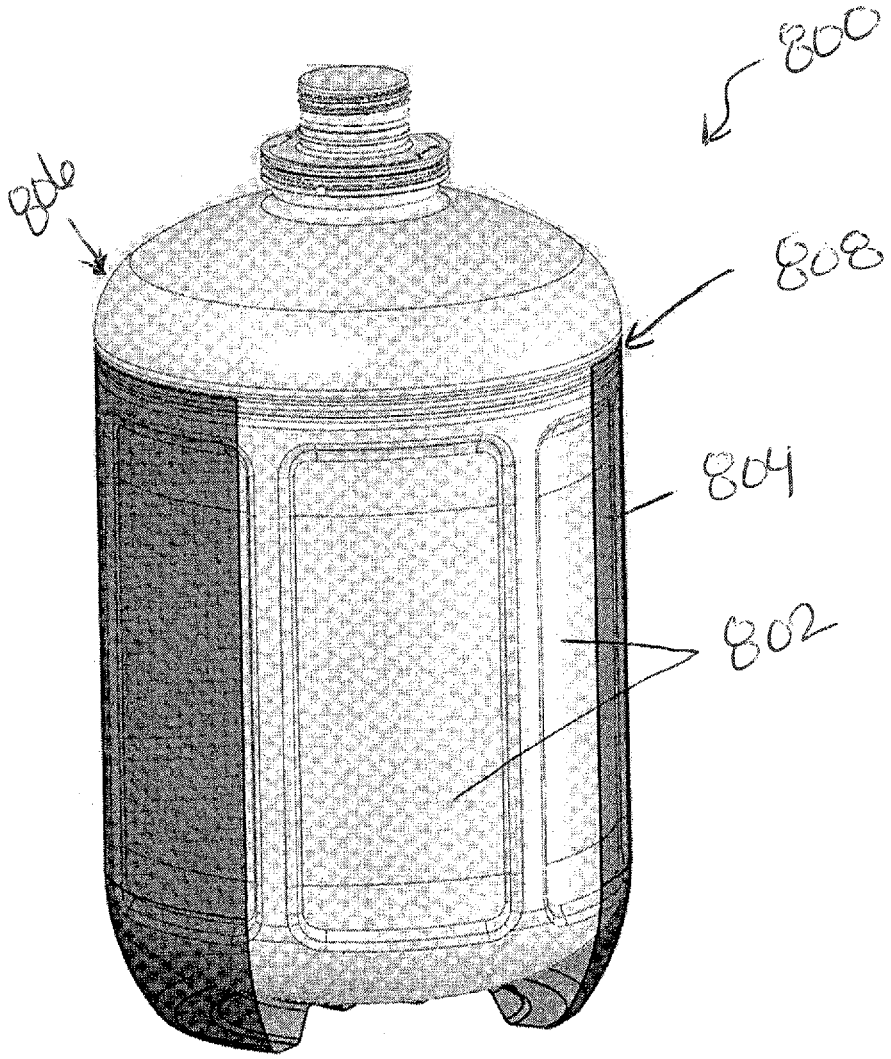
FIG. 8 shows a liner and overpack, according to one embodiment of the present disclosure.

In one particular embodiment, as illustrated in FIG. 8, a dispenser may include a liner-based system 800 having a liner positioned within an overpack 806. The liner and overpack may each be formed by blow molding, such as but not limited to nested co-blow molding, as indicated above. The liner and/or overpack may include surface features, and in some embodiments, such as where nested co-blow molding is used to manufacture the liner and overpack, co-extensive surface features. Particularly, in one embodiment, the liner and overpack may contain surface features, such as but not limited to, one or more indented or protruding panels that may be positioned around the circumference of the liner and overpack. More particularly, in one embodiment, the liner and overpack may contain surface features, such as but not limited to, one or more surface features or panels having a generally rectangular-shaped design. For example, as may be seen in FIG. 8, six generally rectangular-shaped panels 802 may be vertically disposed along the circumference of the liner and/or overpack walls; however, any other number of panels may be suitably used. The panels 802 may have a height generally equal to the non-sloping height of the liner and overpack; that is to say, for example, that the panels 802 may not cover the top portion of a liner and overpack that may begin to slope or curve toward the mouth of the liner and overpack. In some embodiments, the panels 802 may each have substantially the same size and shape as the other panels, or in other embodiments, one or more panels may be differently sized and shaped than one or more other panels. Also, the boundary edge that defines a panel 802 may have any suitable thickness and/or definition, including a shallow depth or a more defined and/or greater depth. In some embodiments, the edging depth may be generally the same for each panel and/or for the entire perimeter of a single panel, while in other embodiments the depth may vary from panel to panel or from one position along the perimeter to another position along the perimeter of the same panel. While the six-panel design is described and shown as generally rectangularly-shaped panels 802, it will be understood that any suitable or desirable geometry is contemplated and within the spirit and scope of the present disclosure. Further, it will be understood that any suitable number of panels, spaced any suitable distance from one another is contemplated and within the spirit and scope of the present disclosure. Generally, surface features such as one or more panels may add strength and/or rigidity to the liner and/or overpack. However, in some embodiments, more shallow edging may also keep the liner from sticking to the overpack.

As may also be seen in FIG. 8, the liner-based system 800 may, in some embodiments, include a chime 804, which may be used, for example, to provide a smooth generally rigid exterior surface for the liner-based system, which can hide any dimpling effects of the liner and/or overpack created by temperature changes and/or may create a surface for labels and the like. In some embodiments, the chime 804 may extend a sufficient height to generally cover the rectangular panel surface features, while in other embodiments, the modified chime may extend any suitable lesser height, including a substantially shorter height as compared to the liner or overpack, which may add free-standing support to the liner-based system. The chime 804 may be comprised of any suitable material, including plastic, for example high density polyethylene (HDPE), PET or any other suitable polyester, or any other suitable material or plastic, or combination thereof. The chime 804 may be relatively rigid as compared to the liner and/or overpack in some embodiments, and because the chime may generally fit over a substantial portion of the liner/overpack, if the liner/overpack collapses, dimples, or otherwise distorts, the chime may generally maintain a smooth and rigid shape. As such, any distortion of the liner/overpack may be generally unobservable from the exterior of the liner-based system. Further, the smooth exterior surface of the chime 804 may provide a generally undistorted surface for adhering a label. The chime 804 may also include a colorant or other additives to protect the liner and overpack from UV light. In some embodiments, the overpack 806 may include connecting features 808 for connecting to the chime, including snap-fit, friction-fit, bayonet, adhesive, or other features that allow the chime to be detachably coupled to the overpack.

Figure 9:
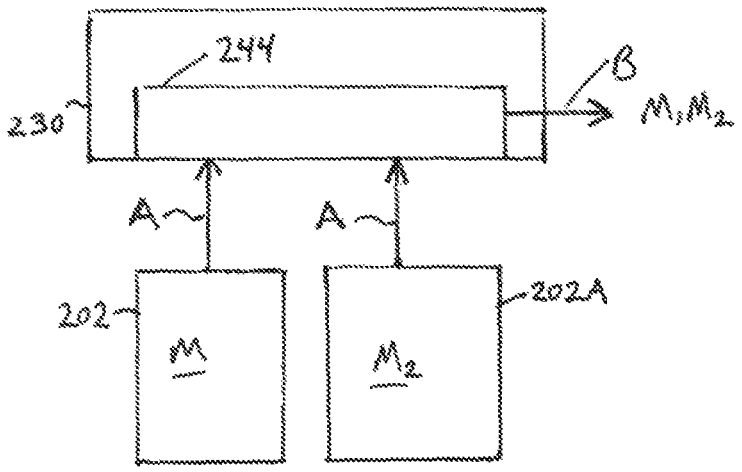
FIG. 9 shows a schematic diagram including a second collapsible liner.

In various embodiments, for example as shown in FIG. 9, a dispenser may, in addition to liner 202, include second collapsible liner 202A that contains a different material $M_2$ to be dispensed, the second liner 202A detachably secured to the dispense assembly 230 with the head assembly 244 in fluid communication with the second liner 202A, as represented by arrows A, wherein upon dispense of the materials M, $M_2$ (arrow B) of the collapsible liner 202 and the second collapsible liner 202A, the materials thereof are mixed.

Further examples and embodiments of the type of liners and overpacks that may be used are disclosed in more detail in: International PCT Appl. No. PCT/US11/55558, titled, "Substantially Rigid Collapsible Liner, Container and/or Liner for Replacing Glass Bottles, and Enhanced Flexible Liners," filed Oct. 10, 2011; International PCT Appl. No. PCT/US11/55560, titled, "Nested Blow Molded Liner and Overpack and Methods of Making Same," filed Oct. 10, 2011; U.S. Prov. Appl. No. 61/556,943, titled "Generally Cylindrically-Shaped Liner for Use in Pressure Dispense Systems and Methods of Manufacturing the Same," filed Nov. 8, 2011; U.S. Prov. Appl. No. 61/468,832, titled "Liner-Based Dispenser," filed Mar. 29, 2011; U.S. Prov. Appl. No. 61/525,540, titled "Liner-Based Dispensing Systems," filed Aug. 19, 2011; U.S. patent application Ser. No. 11/915,996, titled "Fluid Storage and Dispensing Systems and Processes," filed Jun. 5, 2006; International PCT Appl. No. PCT/US10/51786, titled "Material Storage and Dispensing System and Method With Degassing Assembly," filed Oct. 7, 2010, International PCT Appl. No. PCT/US10/41629, U.S. Pat. No. 7,335,721, U.S. patent application Ser. No. 11/912,629, U.S. patent application Ser. No. 12/302,287, and International PCT Appl. No. PCT/US08/85264, each of which is hereby incorporated by reference herein in its entirety. The overpack 312 and liner 202 for use with the dispenser 200 of the present disclosure may include any of the embodiments, features, and/or enhancements disclosed in any of the above noted applications, including, but not limited to, flexible, rigid collapsible, 2-dimensional, 3-dimensional, welded, molded, gusseted, and/or non-gusseted liners, and/or liners that contain folds and/or liners that comprise methods for limiting or eliminating choke-off and liners sold under the brand name NOWpak® by ATMI, Inc. for example. Various features of dispensing systems disclosed in embodiments described herein may be used in combination with one or more other features described with regard to other embodiments.

Figure 4:
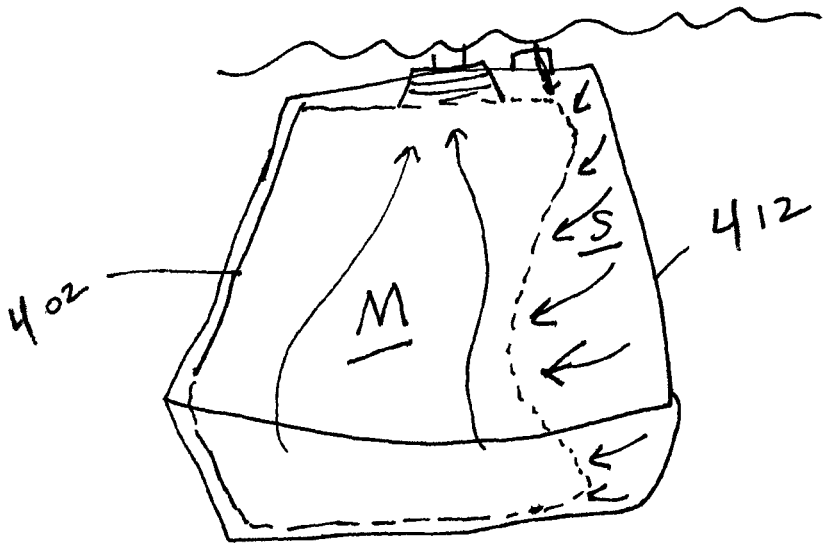
FIG. 4 shows the material of a liner being pressure dispensed, according to one embodiment of the present disclosure.

Embodiments of sprayers/dispensers that include an overpack may be dispensed by either of the methods disclosed above, namely pump dispense or pressure dispense directly into the liner. In an another embodiment, the contents M of the liner 302 may be dispensed by pressure dispense, whereby a substance S such as a fluid, gas, or any other suitable substance may be directed into the overpack 312 between the exterior walls of the liner 302 and the interior walls of the overpack 312. As may be seen in FIG. 4, the substance S that is introduced into the overpack 412 puts pressure on the exterior walls of the liner 402 thereby collapsing the liner 402 inward, forcing the material M of the liner into the dispense channel and out of the head of the sprayer. In embodiments of sprayers 300 using this type of pump dispense, the cover/connector 334 of the dispense assembly 330 may have an inlet 342 such that the fluid, gas, or any other suitable material may be directed into the overpack 312 between the exterior walls of the liner 302 and the interior walls of the overpack 312. Embodiments of the present disclosure utilizing pressure dispense may or may not include a dip tube.

Figure 5:
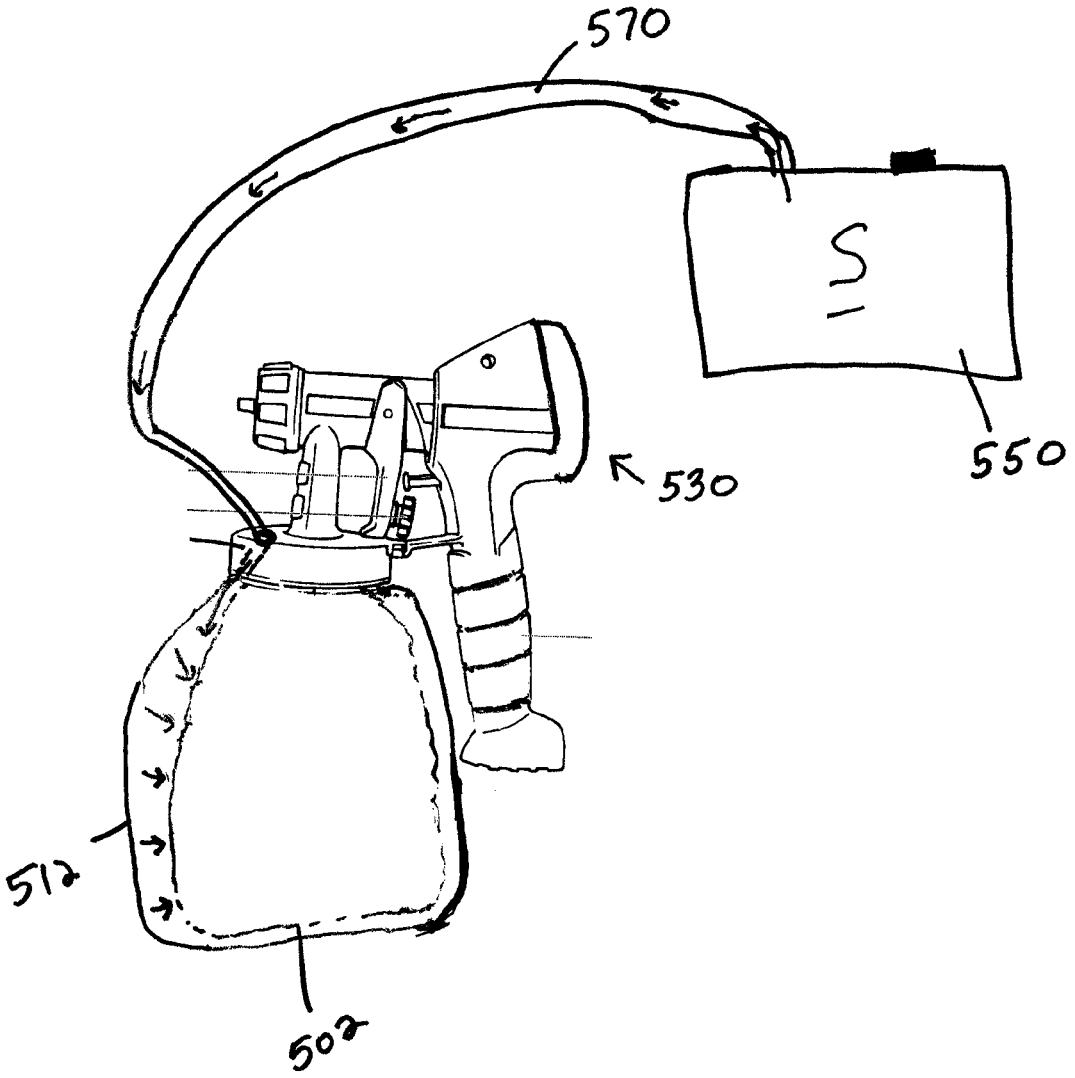
FIG. 5 shows a dispenser that includes a remotely connected dispense mechanism.

While embodiments of a dispense assembly housing the dispense mechanism have been described, other embodiments of sprayers or dispensers incorporating different types of pump assemblies are within the spirit and scope of the present disclosure. For example, in some embodiments, as shown in FIG. 5, the dispense assembly 530 may not include the dispense mechanism. Instead the dispense mechanism 550 may be remotely connected to the liner 502 and/or overpack 512 and/or the dispense assembly 530 by, for example, hoses or tubes 570, or any other suitable means.

Figure 6:
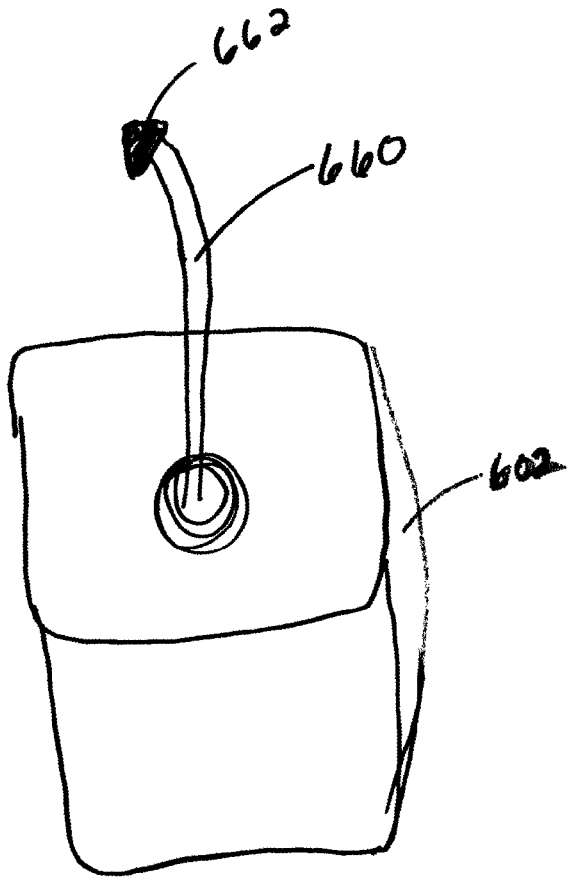
FIG. 6 shows a liner in accordance with one embodiment of the present disclosure.

In yet another embodiment, shown in FIG. 6, a liner 602 may include a tube 660 that attaches to a nozzle 662. In this embodiment, the tube 660 and nozzle 662 may be threaded through the dispense assembly and connect with the head. Accordingly, the parts of the dispenser that require cleaning after use may be further reduced or eliminated.

In some embodiments the nozzle may be configured to provide a wide dispersal pattern, so as to provide wide coverage of the material being sprayed, which may be useful in applications of, but not limited to, pesticides, odor neutralizers, fertilizers, cleaning formulations, irritants, sterilizing preparations, crowd control agents, perfumes, wetting agents, preservatives, pest repellants, aromatherapy, paint strippers, adhesives, lubricants, materials for providing textured surfaces, etc. In one embodiments, an atomizing nozzle may be used, but other means for creating wide dispersal spray patterns are considered within the spirit and scope of the present disclosure.

In still a further embodiment, the entire system may be a disposable system that may be discarded, recycled, or otherwise properly disposed of after the contents of the liner have been exhausted. Accordingly, the material would not need to be transferred from an original package to the dispenser, as the material may be originally packaged in the dispenser. Further, cleaning can be eliminated. Additionally, because the entire system would come ready to use, the material would not need to ever be exposed to the environment or the user until dispense. In such a disposable embodiment, for example, a pressure source may be included as part of the disposable system, or purchased separately, and include a $CO_2$, $N_2$, or other compressed gas cartridge, for example, that may be attached, fixedly or removably, to the dispense mechanism. While discussed with reference to a disposable system, such a pressure source may be similarly used or provided with non-disposable systems, including the other embodiments described herein.

Figure 7:
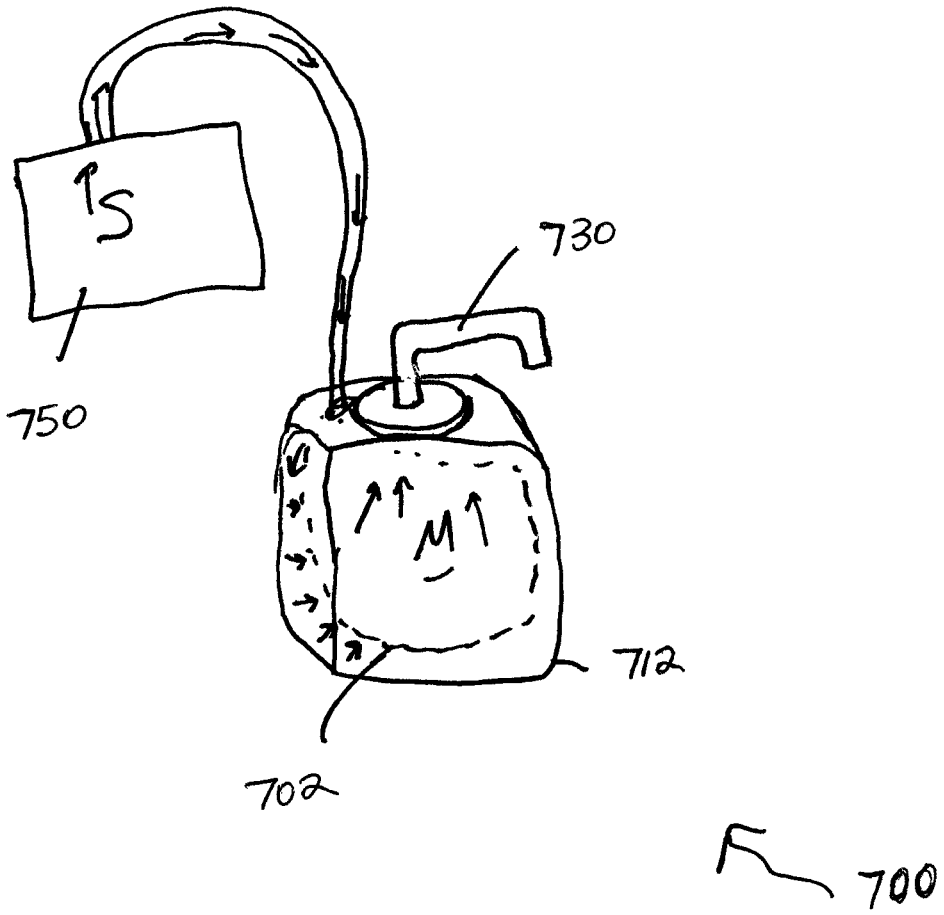
FIG. 7 shows a dispenser, according to one embodiment of the present disclosure.

The foregoing embodiments have generally been described with reference to a hand-held sprayer or dispenser. However, other dispensers are within the spirit and scope of the present disclosure, for example, but not limited to that shown in FIG. 7. In such an embodiment, a material M in the liner 702 may be pressure dispensed, for example, from a remote dispense mechanism 550 through a dispense assembly 530 that may allow for a continuous flow of material M, for example. The dispenser 700 shown in FIG. 7 may be particularly useful for dispensing condiments, for example.

In another embodiment, a dispenser of the present disclosure may include a timer-controlled valve, which in some embodiments may be provided with or integrated with the dispensing assembly, that permits the use of the dispenser remotely or on a scheduled basis. In one embodiment, the timer-controlled valve may be controlled by a microchip integrated with the dispensing assembly or may be controlled remotely, such as by radio, infrared, WiFi, Bluetooth, etc. which may be connected to a controller. The timer-controlled valve could be configured for a one-time dispense event, such as for use with a fogger or pesticide or may be configured for repeating dispense events, such as for introducing an odor neutralizer or aroma into an enclosed space. A dispenser with a timer-controlled valve may be used for any suitable time-controlled dispense application.

In further embodiments, the control valve may be triggered by an external event or external sensing, such as but not limited to spraying a fragrance when a person is near, dispensing a repellent after detection of a pest or a change in ambient lighting, etc. Such external sensing may be provided by one or more ultrasonic proximity detectors, photodetectors, or any other suitable sensors or sensing means or combinations thereof, supplied with the dispenser.

In some dispenser embodiments, the liner, overpack, and/or dispensing assembly may be configured for high flow dispense or dispense of contents of relatively higher viscosity. In one embodiment, such high flow or high viscous dispense can be achieved by providing larger orifice sizes in the liner, overpack, and/or dispensing assembly, which would allow for higher flow rates or the larger flow paths for materials with relatively higher viscosity.

In some embodiments, a dispenser of the present disclosure can include features permitting integrated mixing. Such integrated mixing may be useful, for example, when storing and dispensing two phase or emulsive products or contents. Mixing may be provided, for example, via a magnetically coupled stirring rod or stirring plate; however, other stirring mechanisms can be used, such as but not limited to a Tesla turbine, in order to circulate or mix the contents. In some embodiments, the dispenser or one or more components thereof may need to be modified to provide a more wear resistant, or a substantially wear resistant, location for the mixing device. Such wear resistant area may include, but is not limited to, a dimple or a thickened area in the wall of the liner. In still other embodiments, the dispenser could be configured to mate or be used with a shaker or roller in order to mix the contents stored therein.

In further embodiments, the dispenser could be modified to deliver the contents to a mixing system for use in process. Alternatively, two or more dispensers could be configured to be connected to one another, or their dispense ports or lines, connected to one another, so that the contents thereof may be mixed upon dispense. In yet other embodiments, as discussed above, a single dispenser may include a plurality of liners (optionally within a single overpack) and may be configured to mix the contents of two or more of the plurality of liners upon dispense. Such embodiments may be used, for example, with reactive materials dispensing, which may require isolation of components prior to dispense and may require flow control to deliver the right ratio of isolated components. One example would be systems that polymerize or cross-link on dispense like epoxies, casting compounds such as dental fillers or molds, cleaning agents requiring an oxidizer as a bleach that does not have long term stability when mixed in the full preparation, etc. Generally any scenario where short-lived material would desirably be generated as needed upon mixing could be used with such an embodiment of the present disclosure. In some embodiments, a mixing head or connector may be provided. The mixing head may control the ratio of materials as they are dispensed/mixed. In some embodiments, the mixing head may be able to be cleaned, purged, and/or sterilized. A simplistic embodiment of a mixing head may include orifice plates or constrained volume dip tubes so that the ratio of materials is controlled. However, more complicated mixing heads are suitable for the embodiments of the present disclosure. In other embodiments, a pump, including a portable pump, may be used with, or connected with one embodiment of a dispenser disclosed herein, so as to permit the end user to combine a material or ingredient with the contents of the dispenser upon dispense, or to add a material or ingredient to the packaging system prior to dispense. In still further embodiments, co-blow molded or nested preforms and liners, such as those described in International PCT Appl. No. PCT/US11/55560, titled, "Nested Blow Molded Liner and Overpack and Methods of Making Same," filed Oct. 10, 2011, which was previously incorporated herein, may be used to manufacture a dispenser having greater than two layers. Two or more separate materials may be filled into the spaces between the layers. The dispenser may be configured to mix the separate materials upon dispense.

In other embodiments, the dispensers of the present disclosure may include baffles, baffling features, or other discontinuities in the interior surface(s) thereof to retard settling of the suspended solids contained therein during storage and/or transportation.

The dispensers described herein may be configured as any suitable shape, including but not limited to square, rectangular, triangular or pyramidal, cylindrical, or any other suitable polygon or other shape. Differently shaped dispensers can improve packing density during storage and/or transportation, and may reduce overall transportation costs. Additionally, differently shaped dispensers can be used to differentiate dispensers from one another, such as to provide an indicator of the contents provided within the dispensers or to identify for which application or applications the contents are to be used, etc. In still further embodiments, the dispensers described herein may be configured as any suitable shape in order to "retrofit" the dispensers with existing dispense assemblies or dispense systems.

In some embodiments, the dispensers described herein may include symbols and/or writing that is molded into the dispensers or one or more components thereof. Such symbols and/or writing may include, but is not limited to names, logos, instructions, warnings, etc. Such molding may be done during or after the manufacturing process of the dispensers or one or more components thereof. In one embodiment, such molding may be readily accomplished during the fabrication process by, for example, embossing the mold for the dispensers or one or more components thereof. The molded symbols and/or writing may be used, for example, to differentiate products.

In some embodiments, one or more colors and/or absorbant materials may be added to the materials of the dispensers or one or more components thereof during or after the manufacturing process to help protect the contents of the dispensers from the external environment, to decorate the dispensers, or to use as an indicator or identifier of the contents within the dispensers or otherwise to differentiate multiple dispensers, etc. Colors may be added using, for example, dyes, pigments, nanoparticles, or any other suitable mechanism. Absorbant materials may include materials that absorb ultraviolet light, infrared light, and/or radio frequency signals, etc.

Similarly, in some embodiments, the dispensers or one or more components thereof may be provided with different textures or finishes. As with color and molded symbols and/or writing, the different textures or finishes may be used to differentiate products, to provide an indicator of the contents provided within the dispensers, or to identify for which application or applications the contents are to be used, etc. In one embodiment, the texture or finish may be designed to be a substantially non-slip texture or finish or the like, and including or adding such a texture or finish to the dispensers or one or more components thereof may help improve graspability or handling of the packaging system, and thereby reduce or minimize the risk of dropping of the dispensers. The texture or finish may be readily accomplished during the fabrication process by, for example, providing a mold for the dispensers or one or more components thereof with the appropriate surface features. In other embodiments, the molded dispensers may be coated with the texture or finish. In some embodiments, the texture or finish may be provided on substantially the entire dispenser or substantially the entirety of one or more components thereof. However, in other embodiments, the texture or finish may be provided on only a portion of the dispenser or a portion of one or more components thereof.

Similarly, in some embodiments, the exterior and/or interior walls of the dispensers or one or more components thereof may have any suitable coating provided thereon. The coating may increase material compatibility, decrease permeability, increase strength, increase pinhole resistance, increase stability, provide anti-static capabilities or otherwise reduce static, etc. Such coatings can include coatings of polymers or plastic, metal, glass, adhesives, etc. and may be applied during the manufacturing process by, for example coating a preform used in blow-molding, or may be applied post manufacturing, such as by spraying, dipping, filling, etc.

In some embodiments, the dispensers may include one or more handles. The one or more handles can be of any shape or size, and may be located at any suitable position of the dispensers. Types of handles can include, but are not limited to, handles that are located at the top and/or sides; are ergonomic; are removable or detachable; are molded into the dispensers or are provided after fabrication of the dispensers (such as by, for example, snap fit, adhesive, riveting, screwed on, bayonet-fit, etc.); etc. Different handles and/or handling options can be provided and may depend on, for example but not limited to, the anticipated contents of the dispensers, the application for the dispensers, the size and shape of the dispensers, the anticipated dispensing system for the dispensers, etc.

In order to assist in making the dispensers described herein more sustainable, the dispensers or one or more components thereof, including any overpack, liner(s), handles, etc., may be manufactured from biodegradable materials or biodegradable polymers, including but not limited to: polyhydroxyalkanoates (PHAs), like poly-3-hydroxybutyrate (PHB), polyhydroxyvalerate (PHV), and polyhydroxyhexanoate (PHH); polylactic acid (PLA); polybutylene succinate (PBS); polycaprolactone (PCL); polyanhydrides; polyvinyl alcohol; starch derivatives; cellulose esters, like cellulose acetate and nitrocellulose and their derivatives (celluloid); etc.

In some embodiments, the dispensers may include two or more layers, such as an overpack and a liner, multiple overpacks, or multiple liners. In further embodiments, a dispenser may include at least three layers, which may help ensure enhanced containment of the contents therein, increase structural strength, and/or decrease permeability, etc. Any of the layers may be made from the same or different materials, such as but not limited to, the materials previously discussed herein.

In some embodiments, the dispensers or one or more components thereof may be manufactured from materials that can be recycled or recovered, and in some embodiments, used in another process by the same or a different end user, thereby allowing such end user(s) to lessen their impact on the environment or lower their overall emissions. For example, in one embodiment, the dispensers or one or more components thereof may be manufactured from materials that may be incinerated, such that the heat generated therefrom may be captured and incorporated or used in another process by the same or different end user. In general the dispensers or one or more components thereof may be manufactured from materials that can be recycled, or that may be converted into raw materials that may be used again.

In some embodiments, structural features may be designed into the dispensers that add strength and integrity to the dispensers or one or more components thereof. For example, the base (or chime in some embodiments), top, and sides of the dispensers may all be areas that experiences increased shake and external forces during filling, transportation, installation, and use (e.g., dispensing). Accordingly, in one embodiment, added thickness or structural edifices (e.g., bridge tressel design) may be added to support stressed regions of the dispensers, which can add strength and integrity to the dispensers. Furthermore, any connection region in the dispensers may also experience increased stress during use. Accordingly, any of these such regions may include structural features that add strength through, for example, increased thickness and/or specifically tailored designs. In further embodiments, the use of triangular shapes could be used to add increased strength to any of the above described structures; however, other designs or mechanical support features may be used.

In some embodiments, the dispensers or one or more components thereof, including any overpack or liner(s), may include reinforcement features, such as but not limited to, a mesh, fiber(s), epoxy, or resin, etc. that may be integrated or added to the dispensers or one or more components thereof, or portions thereof, in order to add reinforcement or strength. Such reinforcement may assist in high pressure dispense applications, or in applications for dispensing high viscosity contents or corrosive contents.

In some embodiments, the dispensers may include level sensing features or sensors. Such level sensing features or sensors may use visual, electronic, ultrasonic, or other suitable mechanisms for identifying, indicating, or determining the level of the contents stored in the dispensers. For example, in one embodiment, the dispensers or a portion thereof may be made from a substantially translucent or transparent material that may be used to view the level of the contents stored therein.

In further embodiments, flow metering technology may be integrated into the dispense assembly for a direct measurement of material being delivered from the packaging system to a down stream process. A direct measurement of the material being delivered could provide the end user with data which may help ensure process repeatability or reproducibility. In one embodiment, the integrated flow meter may provide an analog or digital readout of the material flow. The flow meter, or other component of the system, can take the characteristics of the material (including but not limited to viscosity and concentration) and other flow parameters into consideration to provide an accurate flow measurement. Additionally, or alternatively, the integrated flow meter can be configured to work with, and accurately measure, a specific material stored and dispensed from the dispenser. In one embodiment, the inlet pressure can be cycled, or adjusted, to maintain a substantially constant outlet pressure or flow rate.

In alternative embodiments, the systems of the present disclosure may be used for assisting in emergency situations, such as but not limited to use by Hazardous Materials (HazMat) and Emergency Response Teams. HazMat and Emergency Response Teams often have to deal with unknown emergency situations in the field. After a quick assessment of the emergency situation, the identity of the hazard can be categorized as chemical, biological, physical, nuclear, or other hazards. In each situation, the use of portable dispense systems as disclosed herein, used in reverse such as with a vacuum, could be used to locally vacuum up spilled materials and isolate those hazards within a liner-based package for isolation, containment, and/or destruction. Utilization of such portable technology can alleviate concerns from the hazardous material spill or emergency threat situation, regardless of the hazard category being addressed. Isolation of the spilled material, within a liner, for neutralization, destruction, and/or disposal can be achieved on site or at a remote location depending upon the type and severity of the hazard being addressed.

For example, in a chemical spill, an acid or base being transported might leak into the local surroundings. By using a portable vacuum or portable vacuum technology, such as using an embodiment of the systems disclosed herein with a vacuum being applied instead of pressure (e.g., dispense system used in reverse), the acids or bases could be "sucked" into the liner of a portable liner-based package. In some embodiments, a specific neutralization agent may be provided within the package or liner to neutralize the acid or base, or other chemical. Alternatively, the acid or base or other chemical could be isolated and contained within the liner, and transported to another location for later neutralization away from the emergency situation.

As another example, in a biological emergency scenario, a portable vacuum system as disclosed herein, could be used to isolate a biological agent through suction into a liner-based repository. The liner might contain an anti-biological agent to kill the biological material and reduce the immediate threat situation. Alternatively, the isolated biological agent can be isolated and contained within the liner, and transported to another location for later handling, away from the emergency situation, thereby alleviating the potential for widespread destructon and the loss of life.

As yet another example, in a nuclear accident scenario, such as in a nuclear reactor, a radioactive spill could be isolated and contained in a liner-based, portable vacuum system for isolation in another location. The radioactive material, once isolated, can be removed and treated at a remote, non-emergency location. This approach allows increased survival rates and the ability to quickly contain radioactive material in emergency conditions.

Accordingly, the use of a portable pump technology, modified to provide vacuum or suction, can have significant value for these emergency response scenarios. In one embodiment, the systems described above may be modified for suction by replacing the pressure source, in any of the embodiments described above, with a vacuum source. The vacuum source may be a portable vacuum source, and may be separate from the other components of the system or may be an integrated component of the system.

In the foregoing description, various embodiments have been presented for the purpose of illustration and description. They are not intended to be exhaustive or to limit the disclosure to the precise forms disclosed. Obvious modifications or variations are possible in light of the above teachings. The embodiments were chosen and described to provide the best illustration of the principals of the present disclosure and its practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A dispenser comprising:

a dispense assembly having a head assembly;

a rigid collapsible liner that contains a material to be dispensed, the liner including a fitment integral with the liner, the fitment having a closure seal integral with the fitment for providing secure containment of the material to be dispensed, the liner detachably secured to the dispense assembly via the fitment with the head assembly in fluid communication with an interior of the liner, wherein the material in the liner is dispensed out the liner and through the head assembly;

an overpack that holds the liner and that detachably secures to the dispense assembly, the overpack and the liner defining an annular space therebetween; and a dispense mechanism operably coupled with the dispense assembly to cause dispense of the material to be dispensed by introducing a fluid or gas into the annular space between the liner and the overpack, thereby causing the liner to collapse and forcing the material in the liner out of the liner and to the head assembly.

2. The dispenser of claim 1, wherein the head assembly comprises a nozzle in fluid communication with an interior of the liner.

3. The dispenser of claim 1, wherein the liner is manufactured from recyclable material.

4. The dispenser of claim 1, wherein the closure seal is resealable.

5. The dispenser of claim 1, wherein the fitment comprises mating features for detachably securing the liner to the dispense assembly.

6. The dispenser of claim 1, further comprising a second collapsible liner that contains a different material to be dispensed, the second liner detachably secured to the dispense assembly with the head assembly in fluid communication with the second liner, wherein upon dispense of the materials of the collapsible liner and the second collapsible liner, the materials thereof are mixed.

7. A dispenser comprising:

a dispense assembly having a head assembly;

a rigid collapsible liner that contains an ultrapure liquid material to be dispensed, the liner detachably secured to the dispense assembly with the head assembly in fluid communication with an interior of the liner, wherein the material in the liner is dispensed out the liner and through the head assembly;

wherein the liner comprises a substantially rigid liner wall and a fitment that is more rigid than the liner wall, the fitment having a closure seal integral with the fitment for providing secure containment of the material to be dispensed; and an overpack that holds the liner and that detachably secures to the dispense assembly, the overpack and the liner defining an annular space therebetween;

wherein the dispense assembly comprises a dispense mechanism, the dispense mechanism causing dispense of the material to be dispensed by introducing a fluid or gas into the annular space between the liner and the overpack, thereby causing the liner to collapse and forcing the material in the liner out of the liner and to the head assembly.

8. The dispenser of claim 7, wherein the substantially rigid liner wall has a thickness in the range of about 0.05 mm to about 3 mm.

9. The dispenser of claim 7, wherein the substantially rigid liner wall has a thickness in the range of about 0.2 mm to about 1 mm.

10. The dispenser of claim 7, wherein the fitment is threaded.

11. The dispenser of claim 7, wherein the liner is collapsible at a pressure in the annular space of less than about 20 psi.

12. The dispenser of claim 7, wherein the rigid collapsible liner is adapted to be free-standing during filling, transportation and/or storage of the liner.

* * * * *